US008248178B2

(12) United States Patent
Lange

(10) Patent No.: US 8,248,178 B2
(45) Date of Patent: Aug. 21, 2012

(54) HIGH POWER WAVEGUIDE POLARIZER WITH BROAD BANDWIDTH AND LOW LOSS, AND METHODS OF MAKING AND USING SAME

(75) Inventor: Mark J. Lange, Malibu, CA (US)

(73) Assignee: The Aerospace Corporation, El Segundo, CA (US)

( * ) Notice: Subject to any disclaimer, the term of this patent is extended or adjusted under 35 U.S.C. 154(b) by 400 days.

(21) Appl. No.: 12/630,593

(22) Filed: Dec. 3, 2009

(65) Prior Publication Data

US 2011/0133863 A1 Jun. 9, 2011

(51) Int. Cl.
*H01P 1/165* (2006.01)
*H01P 1/17* (2006.01)

(52) U.S. Cl. ..... 333/21 A; 333/21 R

(58) Field of Classification Search ..... 333/21 A, 333/21 R

See application file for complete search history.

(56) References Cited

U.S. PATENT DOCUMENTS

| | | | | |
|---|---|---|---|---|
| 2,546,840 A | | 3/1951 | Tyrrell | |
| 2,607,849 A | | 8/1952 | Purcell et al. | |
| 2,933,731 A | | 4/1960 | Foster et al. | |
| 4,100,514 A | * | 7/1978 | DiTullio et al. | 333/157 |
| 4,523,160 A | | 6/1985 | Ploussios | |
| 4,654,611 A | | 3/1987 | Wong et al. | |
| 4,672,334 A | * | 6/1987 | Saad | 333/21 A |
| 4,725,795 A | | 2/1988 | Ajioka et al. | |
| 4,982,171 A | | 1/1991 | Figlia et al. | |
| 6,097,264 A | | 8/2000 | Vezmar | |
| 6,118,412 A | | 9/2000 | Chen | |
| 6,624,715 B2 | * | 9/2003 | Yuanzhu | 333/21 A |
| 6,664,866 B2 | * | 12/2003 | Yoneda et al. | 333/21 A |

FOREIGN PATENT DOCUMENTS

| | | | |
|---|---|---|---|
| JP | 53 72552 | * | 6/1978 |
| JP | 54 124656 | * | 9/1979 |

OTHER PUBLICATIONS

Chen et al., "A wide-band square-waveguide array polarizer," IEEE Transactions on Antennas and Propagation, May 1973, 389-391.

Bornemann et al., "Ridge waveguide polarizer with finite and stepped-thickness septum," IEEE Transactions on Microwave Theory and Techniques, vol. 43, No. 8, Aug. 1995, 1782-1787.

* cited by examiner

*Primary Examiner* — Robert Pascal
*Assistant Examiner* — Kimberly Glenn
(74) *Attorney, Agent, or Firm* — Jones Day; Nicola A. Pisano; Jaime D. Choi

(57) ABSTRACT

Embodiments of the invention provide high power waveguide polarizers with broad bandwidth and low loss, and methods of making and using the same. Under one aspect of the present invention, a waveguide polarizer includes a hollow waveguide body having an interior surface; a first ridge disposed on the interior surface of the hollow waveguide body and having an inward-facing surface; and a first plurality of projections disposed on the inward-facing surface of the first ridge. The projections may have a width that is narrower than that of the ridge, and a length that is tunable. The length of the projections may be selected to induce about a 90-degree phase delay in a first mode propagating in a plane parallel to the first ridge relative to a second mode propagating in a plane perpendicular to the first ridge.

17 Claims, 19 Drawing Sheets

HIGH POWER WAVEGUIDE POLARIZER WITH BROAD BANDWIDTH AND LOW LOSS, AND METHODS OF MAKING AND USING SAME

STATEMENT OF GOVERNMENT INTEREST

This invention was made with Government support under contract FA 8802-04-C-0001 awarded by the Department of the Air Force. The Government has certain rights in the invention.

FIELD OF THE INVENTION

This application generally relates to waveguide polarizers, and methods of making and using same.

BACKGROUND OF THE INVENTION

In general, guided-wave polarizer technology converts a circularly-polarized wave into a linear-polarized wave while maintaining orthogonality of the two possible senses of each polarized wave. For example, a guided-wave polarizer may convert a left-hand, circularly-polarized (LHCP) wave into a horizontal (H) linearly-polarized wave; alternatively, such a polarizer may convert a right-hand, circularly-polarized (RHCP) wave into a vertical (V) linearly-polarized wave. As is known in the art, such polarization conversion is based on decomposing circularly polarized waves into a superposition of two orthogonal, linearly polarized waves, in phase quadrature. Whether the composite field is LHCP or RHCP depends on which of the two linear components lags behind the other. A guided-wave polarizer advances or delays one of the field components by 90 degrees of phase relative to the other, bringing the two linear components into phase with one another, resulting in a linearly polarized composite wave. A guided-wave polarizer may also convert a linearly polarized wave into a circularly polarized wave, by the reverse process. Tolerances and errors in the conversion process typically result in some ellipticity of the wave, regardless of the desired polarization.

Many different structures have been developed to modify the polarization of a wave. One simple structure for converting from linear polarization to circular polarization is a hollow rectangular waveguide with a width that is slightly different from its height. A linearly polarized wave is introduced at a 45-degree angle relative to the waveguide; the wave is decomposed into two superimposed orthogonal linear TE10 modes (dominant modes) within the waveguide. As the two modes propagate through the waveguide, they will experience different cut-off frequencies and phase velocities as a result of the different width and height. The length of the waveguide is chosen such that one of the modes accumulates a 90-degree phase delay relative to the other mode across the length of the waveguide. The sense of the resulting circular polarization depends on the relative orientation of the linear polarization used to excite the two orthogonal modes, and the waveguide. Although this technique is relatively simple, only waves having a wavelength matched to the length of the particular waveguide will accumulate the 90-degree phase delay, resulting in a useful bandwidth of less than 1%.

Alternatively, as illustrated in FIG. 1A, another common approach is the use of a dielectric slab polarizer 100, such as described in U.S. Pat. No. 2,607,849 to Purcell et al. Polarizer 100 includes a hollow cylindrical waveguide body 110, formed of a conductive material, having a slab 120 of dielectric material disposed therein. In this case it is useful to consider the incident linear TE01 mode as the superposition of two orthogonal TE01 modes 151, 152, each at half the power of the composite mode. This places one of the component modes 151 parallel to slab 120 and the other component mode 152 perpendicular to slab 120. The parallel mode 151 strongly couples to slab 120, in which it experiences a reduced phase velocity that is inversely proportional to the square root of the dielectric constant of slab 120. The dielectric constant, thickness, and length of slab 120 are selected such that parallel mode 151 accumulates a total phase delay of 90 degrees with respect to the perpendicular mode 152 as the two modes propagate through polarizer 100.

One drawback of polarizer 100 is that differential phase shift induced by slab 120 monotonically increases with frequency. For example, FIG. 1B is a plot of the calculated differential transmission phase of the dielectric slab polarizer of FIG. 1A as a function of normalized frequency. To perform the calculation, the polarizer was modeled and its performance simulated using a High Frequency Structure Simulator (HFSS), commercially available from Ansoft (Pittsburgh, Pa.). Based on the calculation, it can be seen that the differential transmission phase increases monotonically with frequency. The bandwidth of polarizer 100 may be defined as the frequency range over which the differential transmission phase is within 90 degrees plus or minus some tolerance value, for example, plus or minus five degrees, divided by the center frequency of that frequency range. Using such a definition, the marginal performance that can be achieved with the dielectric slab polarizer of FIG. 1A is limited to a bandwidth of less than about 4-5%.

Another drawback of polarizer 100 is that parallel mode 151 must propagate within slab 120. As such, the dissipative loss of the parallel mode 151 will be greater than the loss of the perpendicular mode 152, because dielectric materials produce more Ohmic loss than conductive materials. Dielectric slab 120 is also susceptible to outgassing and to damage, requiring the power of the incoming wave to be maintained below the damage threshold of the dielectric material. Additionally, polarizer 100 may only meet performance requirements within a relatively narrow temperature range of operation, because (a) the dielectric constant of slab 120, and thus the accumulated phase delay of mode 151, varies with temperature, and (b) the coefficient of thermal expansion of slab 120 may be substantially different than that of cylindrical waveguide body 110, potentially damaging polarizer 100 if exposed to temperatures outside of an acceptable range. Furthermore, repeatability of the dielectric material properties and dimensions may be poor, causing performance to vary from polarizer to polarizer.

FIG. 2A illustrates another prior art waveguide polarizer 200, such as described in U.S. Pat. No. 2,546,840 to Tyrell. Polarizer 200 includes a hollow cylindrical waveguide body 210, formed of a conductive material. Polarizer 200 also includes first and second stepped ridges 221, 222, which are arranged opposite one another inside of waveguide body 210. Stepped ridges 221, 222 reduces the cut-off frequency and phase velocity of a first mode polarized in the y-direction relative to a second mode polarized in the x-direction, inducing a phase shift between the two modes. Each of stepped ridges 221, 222 includes three steps of varying heights, 261, 262, 263, which provide impedance matching for the incoming and outgoing waves. Steps 261 and 263 may have lengths of about ¼ of the guide wavelength of the mode propagating in the plane parallel to ridges 221, 222 to improve impedance matching. As illustrated in FIG. 2B, the calculated differential transmission phase between modes 251 and 252 within polarizer 200 decreases monotonically with frequency, yielding a useful bandwidth of only about 5%, assuming a tolerance of plus or minus five degrees about a ninety degree phase delay.

FIG. 3 illustrates another prior art waveguide polarizer 300, such as described in "Ridge Waveguide Polarizer with Finite and Stepped-Thickness Septum" by Bornemann et al., IEEE Transactions on Microwave Theory and Techniques, Vol. 43, No. 8, 1782-1787 (August 1995). Polarizer 300 includes a hollow square waveguide body 310, formed of a conductive material, and stepped septum 320 that bisects waveguide body 310. Stepped septum 320 has steps of increasing size along the length of polarizer 300; as described in Bornemann et al., the steps may also have increasing thickness. As orthogonal modes 351, 352 propagate along polarizer 300, mode 351 accumulates a 90-degree phase change relative to mode 352. Bornemann et al. report performance characteristics corresponding to a bandwidth of 21% for a ±5.4 degree (0.8 dB) phase variation from 90 degrees.

Polarization conversion can alternatively take place on an unguided, free-space wave with the use of multi-layer grids of linear or meander-line gratings. These structures tend to be relatively large and costly from a material standpoint.

Thus, prior art polarizers suffer from a number of deficiencies, including low bandwidth, high loss, low power handling capability, and/or large size.

SUMMARY

Embodiments of the invention provide high power waveguide polarizers with broad bandwidth and low loss, and methods of making and using same. Specifically, embodiments of the invention provide a compact waveguide polarizer that includes a hollow waveguide body and at least one ridge, for example, a pair of ridges, three ridges, or two pairs of ridges, disposed along the interior of the waveguide body. Each ridge includes on its upper surface a plurality of spaced projections, such as cylindrical or rectangular posts, or serrations. The ridges and spaced projections together produce a broad band differential phase shift between two orthogonal modes propagating through the waveguide body. Specifically, the spaced projections provide a small capacitive reactance that offsets the inductive loading of the lower portions of the ridges. As a result, a mode propagating parallel to the ridges accumulates a phase delay relative to a mode propagating orthogonal to the ridges that is substantially independent of wavelength over a relatively wide bandwidth. The differential phase delay may easily be tuned by adjusting the length of the projections. The bandwidth of the polarizer may in some embodiments be enhanced by configuring the projections so as to have a narrower width than the width of the ridge on which they are disposed. Additionally, the polarizers may be inexpensively fabricated, are compact, have no dielectric losses, may accept high power fields, and may be used in a wide variety of environmental conditions.

Under one aspect of the present invention, a waveguide polarizer includes a hollow waveguide body having an interior surface; a first ridge disposed on the interior surface of the hollow waveguide body and having an inward-facing surface; and a first plurality of projections disposed on the inward-facing surface of the first ridge. The projections of the first plurality may in some embodiments have a width and a length, wherein the width is narrower than a width of the first ridge, and wherein the length is tunable.

Some embodiments further include a second ridge disposed on the interior surface of the hollow waveguide body opposite the first ridge, the second ridge having an inward-facing surface; and a second plurality of projections disposed on the inward-facing surface of the second ridge. The projections of the second plurality may in some embodiments have a width and a length, wherein the width is narrower than a width of the second ridge, and wherein the length is tunable.

Some embodiments still further include third and fourth ridges disposed on the interior surface of the hollow waveguide body, the third ridge and the fourth ridge each having an inward-facing surface; a third plurality of projections disposed on the inward-facing surface of the third ridge; and a fourth plurality of projections disposed on the inward-facing surface of the fourth ridge. The third and fourth ridges may in some embodiments each have a height that is shorter than a height of the first and second ridges, and may be disposed orthogonally to the first and second ridges. The projections of the third and fourth pluralities may in some embodiments have a length that is shorter than the length of the projections of the first and second pluralities.

In some embodiments, the length of the projections is tuned so as to induce about a 90-degree phase delay in a first mode propagating in a plane parallel to the first ridges relative to a second mode propagating in a plane perpendicular to the first ridge.

The projections may include cylindrical posts. Alternatively, the projections may include rectangular posts. The projections may include screws.

The waveguide polarizer may have a bandwidth of at least 30% about a center wavelength. For example, the waveguide polarizer may have a bandwidth of at least 50% about a center wavelength.

The first plurality of projections may comprise between four and fifty projections.

In some embodiments, each projection comprises a conductor. The conductor may include a metal selected from the group consisting of aluminum, magnesium, zinc, titanium, steel, chromium, and gold.

The hollow waveguide body may have a substantially symmetrical cross section.

The first ridge may be formed integrally with the waveguide body. The first ridge has a height and a length. The height may be substantially uniform along the length. Alternatively, the height may vary along the length. The width of the first ridge may vary along the length.

In one embodiment, the first ridge has a length that is approximately equal to a wavelength of a mode propagating through the waveguide body.

Under another aspect of the present invention, a method of forming a waveguide polarizer includes providing a waveguide body having an interior surface; providing a ridge; providing a plurality of projections having a width that is narrower than a width of the ridge; coupling the ridge to the interior surface of the waveguide body, the ridge having an inward-facing surface; coupling the plurality of projections to the inward-facing surface of the ridge; and tuning a length of the projections.

Coupling the plurality of projections to the inward-facing surface of the ridge may include screwing each projection into the ridge. Tuning the length of the projections may include selecting a depth to which the projections are screwed into the ridge based on a phase delay to be induced in a mode propagating parallel to the ridge relative to a mode propagating perpendicular to the ridge.

DETAILED DESCRIPTION

Overview

Figure 2A:
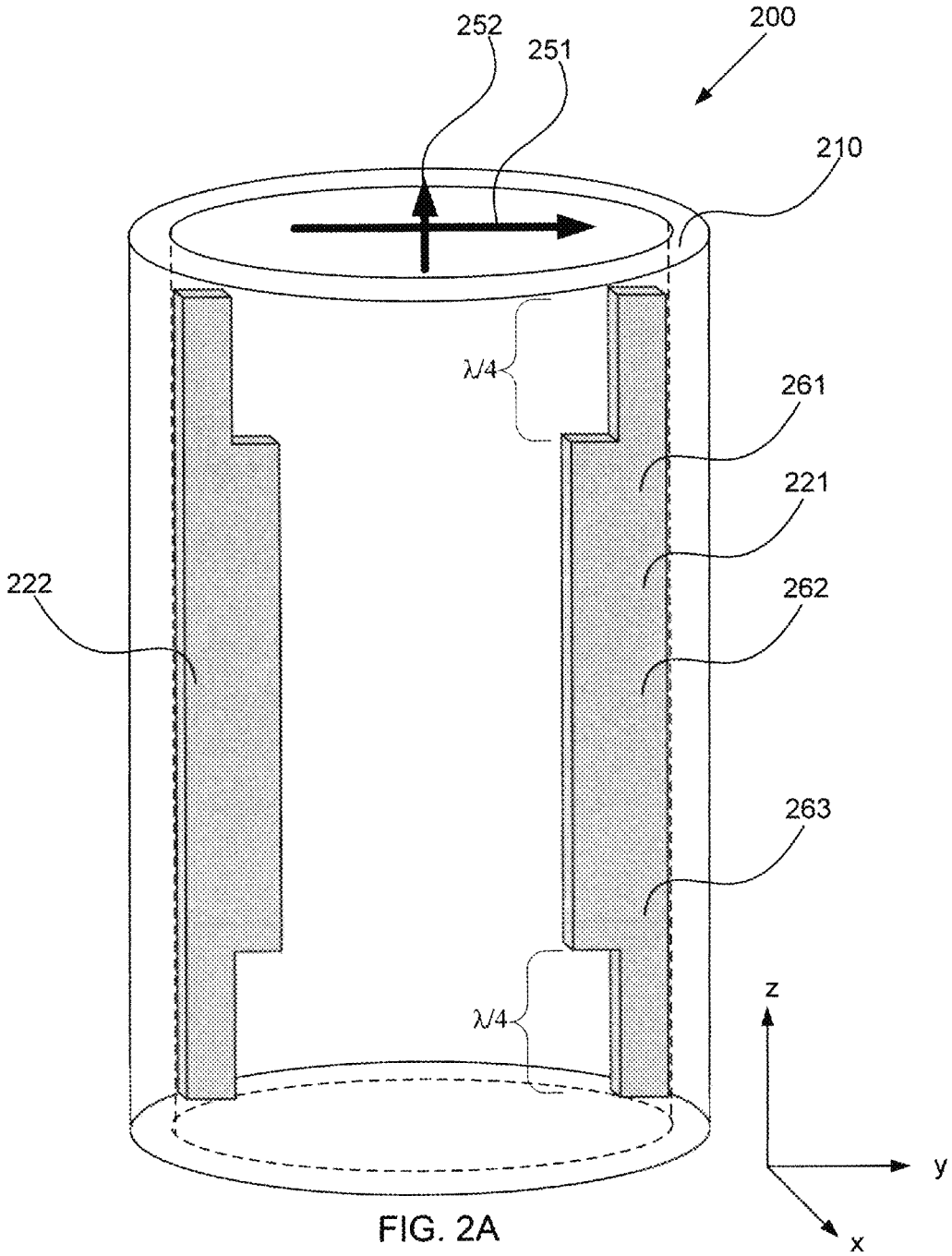
FIG. 2A PRIOR ART
FIG. 2A schematically illustrates a perspective view of a prior art ridge polarizer.
Figure 2B:
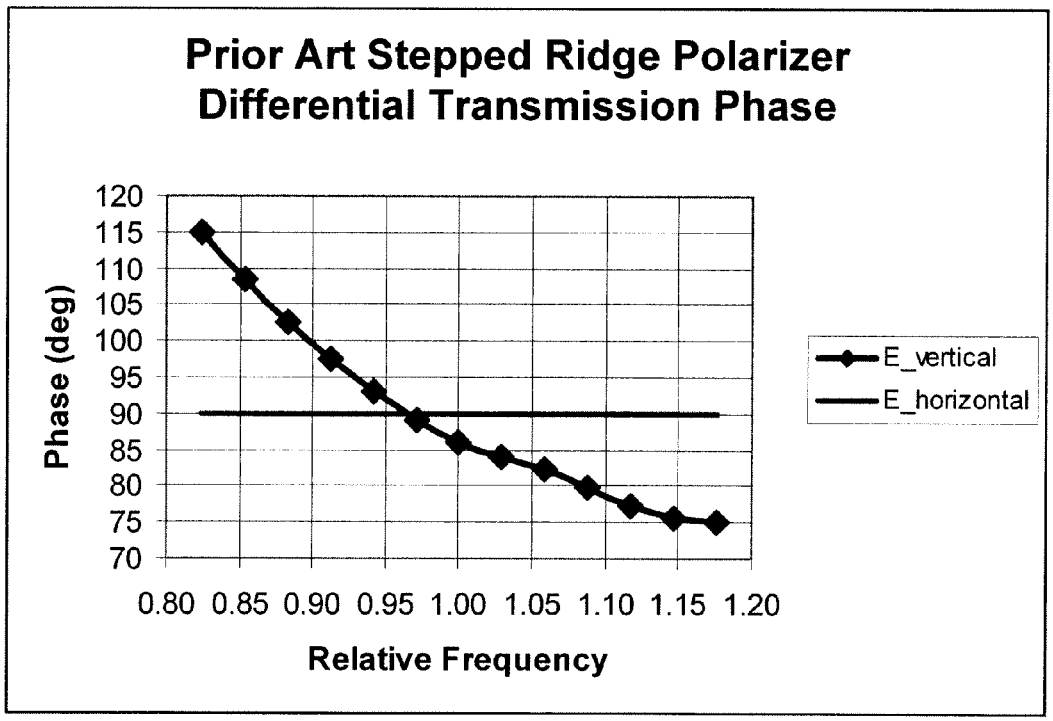
FIG. 2B PRIOR ART
FIG. 2B is a plot of the calculated transmission phase response of the ridge polarizer of FIG. 2A.
Figure 3:
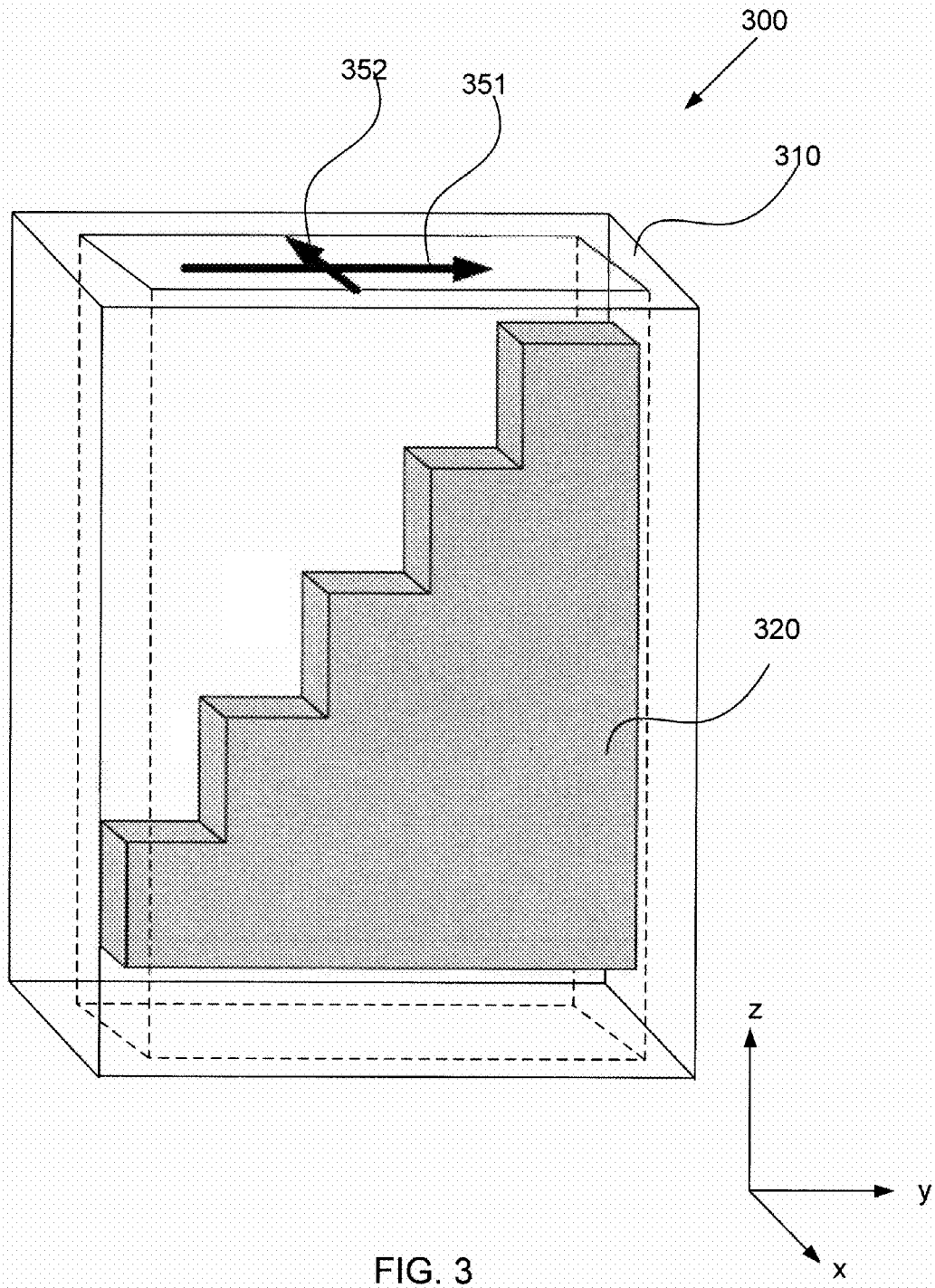
FIG. 3 PRIOR ART
FIG. 3 schematically illustrates a perspective view of a prior art stepped septum polarizer.

Embodiments of the invention provide waveguide polarizers having significantly improved performance relative to the prior art polarizers described above. First, the inventive waveguide polarizers have a significantly broader bandwidth than previously achieved with slab, stepped ridge, or septum polarizers, for example. This broader bandwidth is achieved, in part, by providing, within a hollow cylindrical waveguide body, at least one ridge, for example, a pair of ridges, that include a plurality of spaced projections on their upper surfaces. As described in greater detail below, the projections may be cylindrical or rectangular posts, or serrations, for example, that protrude from a lower portion of the ridges. Like the ridges discussed above with respect to FIG. 2A, the inventive ridges induce a differential phase delay in orthogonal modes traveling through the waveguide body. However, the spaced projections modify the wavelength dependence of the phase delay induced by the ridges, significantly broadening the bandwidth of the polarizer. Specifically, whereas the ridges of FIG. 2A induce a phase shift that increases monotonically with frequency, as illustrated in FIG. 2B, the inventive ridges induce a phase shift that remains substantially constant over a wide frequency range, thus significantly broadening the bandwidth of the polarizer.

Figure 1A:
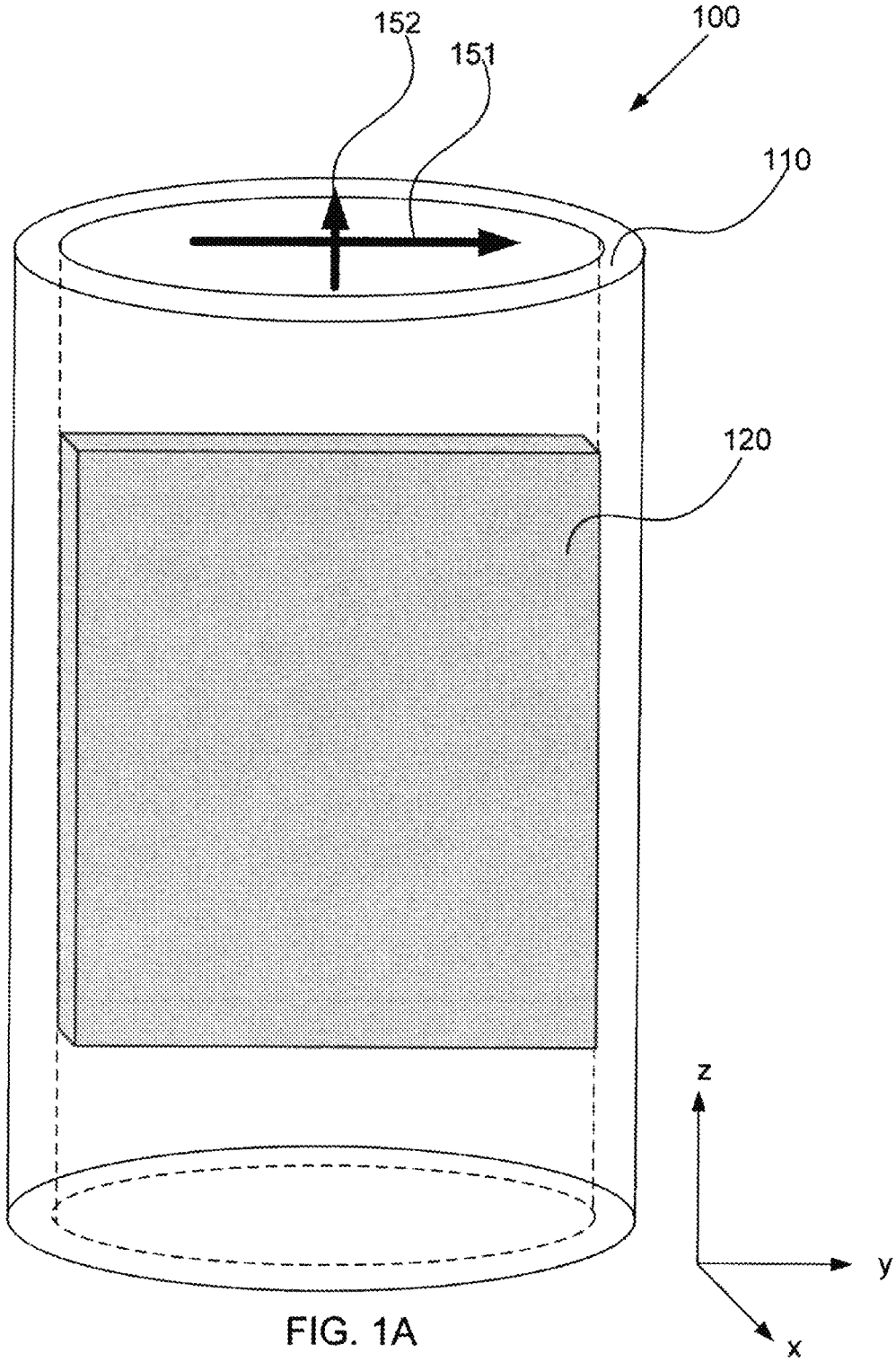
FIG. 1A PRIOR ART
FIG. 1A schematically illustrates a perspective view of a prior art dielectric slab polarizer in a cylindrical waveguide.
Figure 1B:
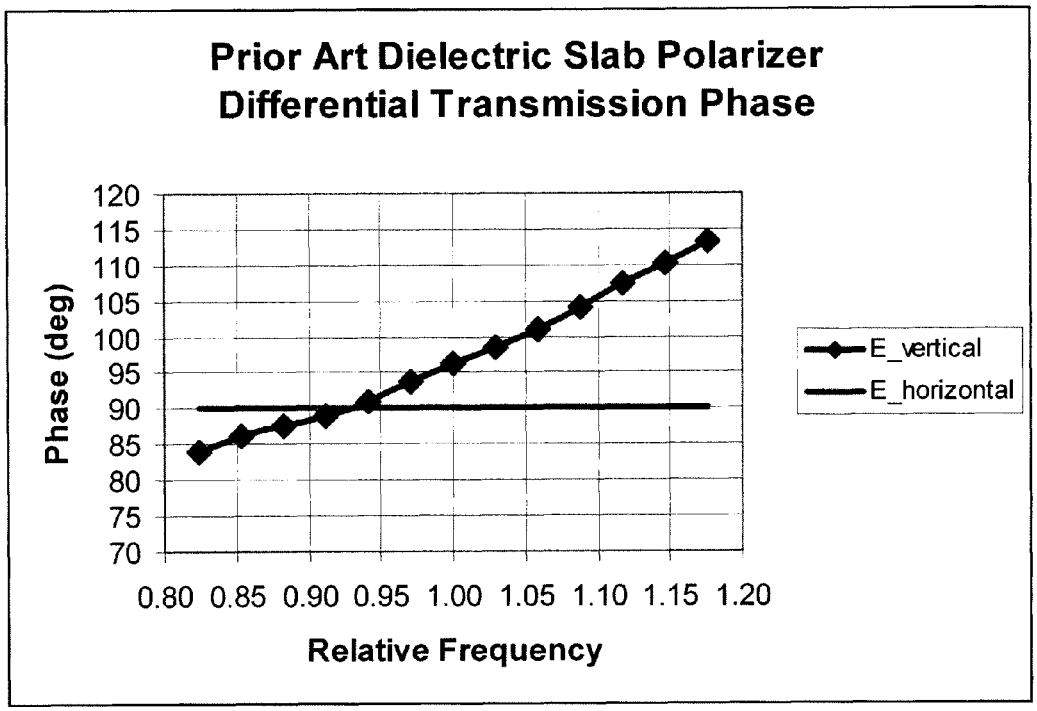
FIG. 1B PRIOR ART
FIG. 1B is a plot of the calculated transmission phase response of the dielectric slab polarizer of FIG. 1A.

Additionally, in some embodiments, the waveguide polarizer may be constructed entirely of conductive materials, e.g., metals, thus avoiding the use of dielectric materials such as discussed above with respect to FIGS. 1A-1B. As such, the polarizers may be reliably and inexpensively manufactured from a variety of suitable materials that may be used in harsh conditions, and are not susceptible to significant outgassing, in contrast to dielectric materials. Additionally, the polarizers are highly efficient because they do not cause ohmic losses. Moreover, the polarizers may be constructed so as to have easily tunable differential phase delay characteristics, allowing them to be easily modified during or after fabrication for operation with a wide variety of bandwidths.

Waveguide Polarizer Structure

Figure 4A:
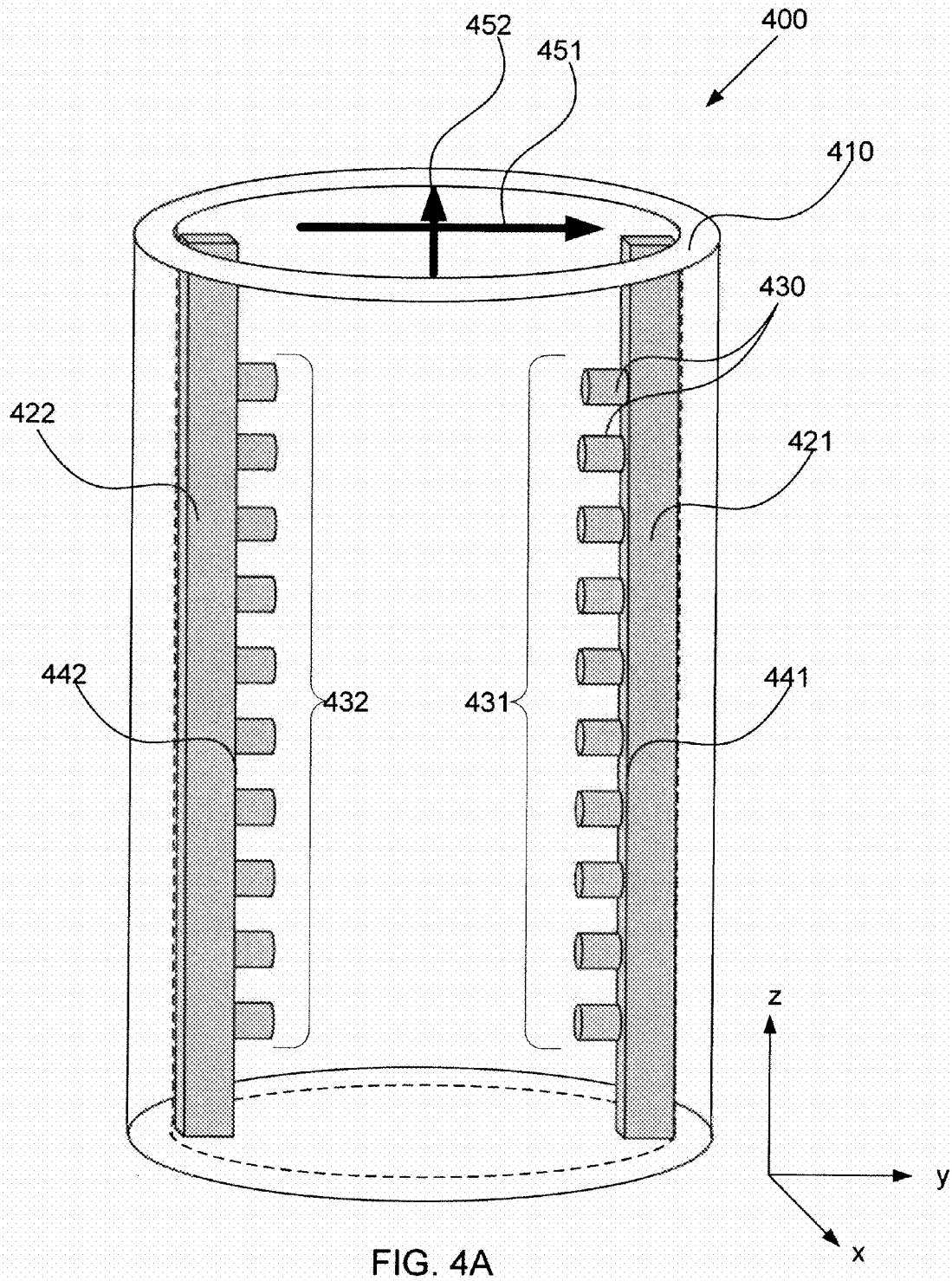
FIG. 4A schematically illustrates a perspective view of a waveguide polarizer, according to some embodiments of the present invention.

FIG. 4A schematically illustrates a perspective view of a waveguide polarizer 400 constructed according to some embodiments of the present invention. Polarizer includes hollow waveguide body 410, first and second ridges 421, 422, and first and second pluralities of projections 431, 432. First and second ridges 421, 422 are disposed opposite one another on the interior surface of hollow waveguide body 410, and each have an inward-facing surface 441, 442, respectively. The first and second pluralities of projections 431, 432 are respectively disposed on the inward-facing surfaces 441, 442 of ridges 421, 422. In one example, each projection 430 is shaped as a cylindrical post. Projections 430 may also have a width that is narrower than a width of ridges 421, 422. Such a width may in some embodiments enhance the bandwidth of waveguide polarizer 400.

In the embodiment illustrated in FIG. 4A, ridges 421, 422 are integrally formed with hollow waveguide body 410, and projections 430 are formed separately from ridges 431, 432 and are coupled thereto. Ridges 421, 422 have a substantially uniform height along their length, as well as a substantially uniform width along their length. In other embodiments, the height and/or width may vary along their length. Projections 430 all have substantially the same length as one another, and each plurality of projections 431, 432 includes the same number of projections 430. In other embodiments, projections 430 may have different heights from one another (e.g., the heights of projections 430 may vary relatively smoothly along ridges 421, 422). Hollow waveguide body 410, ridges 421, 422, and projections 430 are constructed of one or more conductive materials, such as a metal, for example aluminum, magnesium, zinc, titanium, or steel, which optionally may be coated with another conductor, e.g., with chromium, gold, platinum, or silver. In one embodiment, projections 430 are screws, such as machine screws or self-tapping screws, screwed into ridges 421, 422, enabling their length to be tunable. In other embodiments, for example as described below with respect to FIGS. 5A-7B, protrusions 430 may instead be formed integrally with ridges 421, 422 and/or may be formed in different shapes. Alternatively, or additionally, ridges 421, 422 may instead be formed separately from hollow waveguide body 410 and coupled thereto, as described in greater detail below.

A cooperative effect of ridges 421, 422 and the first and second pluralities of projections 431, 432 enhance the performance of waveguide polarizer 400 relative to that of the prior art polarizers described above. Specifically, the differential transmission phase $\Delta\phi_{Total}$ through polarizer 400 may be described, in part, by Equation 1:

$$\Delta\phi_{Total} = 2\pi l_g\left(\frac{1}{\lambda_{gh}} - \frac{1}{\lambda_{gw}}\right) + \frac{\pi}{2}\frac{nfl_p}{c}\left(1 - \left(\frac{f - f_r}{f_r}\right)^2\right)$$

where $l_g$ is the length of the waveguide, $\lambda_{gh}$ is the guide wavelength in the plane perpendicular to ridges 421, 422, $\lambda_{gw}$ is the guide wavelength in the plane parallel to ridges 421, 422 (which itself depends on the height and width of ridges 421, 422), n is the number of projections 430 in either of the pluralities of projections 431 or 432, f is the frequency of the wave in the waveguide, $l_p$ is the length of each projection, c is the speed of light, and $f_r$ is the resonance frequency of each projection (which itself depends on the length and width of the projections). As those of ordinary skill in the art will appreciate, the differential transmission phase also depends, in part, on other parameters, such as the diameter and shape of hollow waveguide body 410. However, for the sake of analytical simplicity, Equation 1 omits such factors, and instead primarily represents the analytical relationship between the waveguide length $l_g$, ridge height and width (via the terms $\lambda_{gh}$ and $\lambda_{gw}$), and projection length and width (via the terms $l_p$ and $f_r$). In embodiments where it is desired to convert a linearly polarized wave into a circularly polarized wave, or vice versa, the design parameters of the waveguide polarizer are selected such that differential transmission phase $\Delta\phi_{Total}$ is approximately ±90 degrees. In embodiments where it is desired to convert a linearly polarized wave into an elliptically polarized wave, the design parameters of the waveguide polarizer are selected such that differential transmission phase $\Delta\phi_{Total}$ is between ±90 and 0 degrees, e.g., 45 degrees.

As can be seen from the first term of Equation 1, the differential transmission phase $\Delta\phi_{Total}$ experienced by mode 451 relative to mode 452 within waveguide polarizer 400 is inversely proportional to the difference between the guide wavelengths $\lambda_{gh}$ and $\lambda_{gw}$. As the frequency of the wave propagating through waveguide body 410 increases, the difference between the guide wavelengths $\lambda_{gh}$, $\lambda_{gw}$ decreases. As such, a waveguide polarizer containing ridges 421, 422 alone, similar to that described further above with reference to FIGS. 2A-2B, would exhibit a differential transmission phase that decreases monotonically with frequency. As can be seen from the second term of Equation 1, the differential transmission phase $\Delta\phi_{Total}$ is proportional to the number of projections n, the length of the projections $l_p$, and the resonance frequency of the projections $f_r$. Thus, a waveguide polarizer containing projections 430 alone would exhibit a differential transmission phase that increases monotonically with frequency. As can be seen from Equation 1, the frequency dependencies of ridges 421, 422 and projections 430 oppose each other; that is, one decreases with frequency, while the other increases with frequency. Phrased differently, the projections provide a periodic capacitive loading that offsets the inductive loading provided by the ridges. As a result, the total differential transmission phase $\Delta\phi_{Total}$ is substantially independent of frequency within a wide frequency range, thus providing a polarizer having significantly broader bandwidth than the prior art polarizer of FIG. 2A.

Figure 4B:
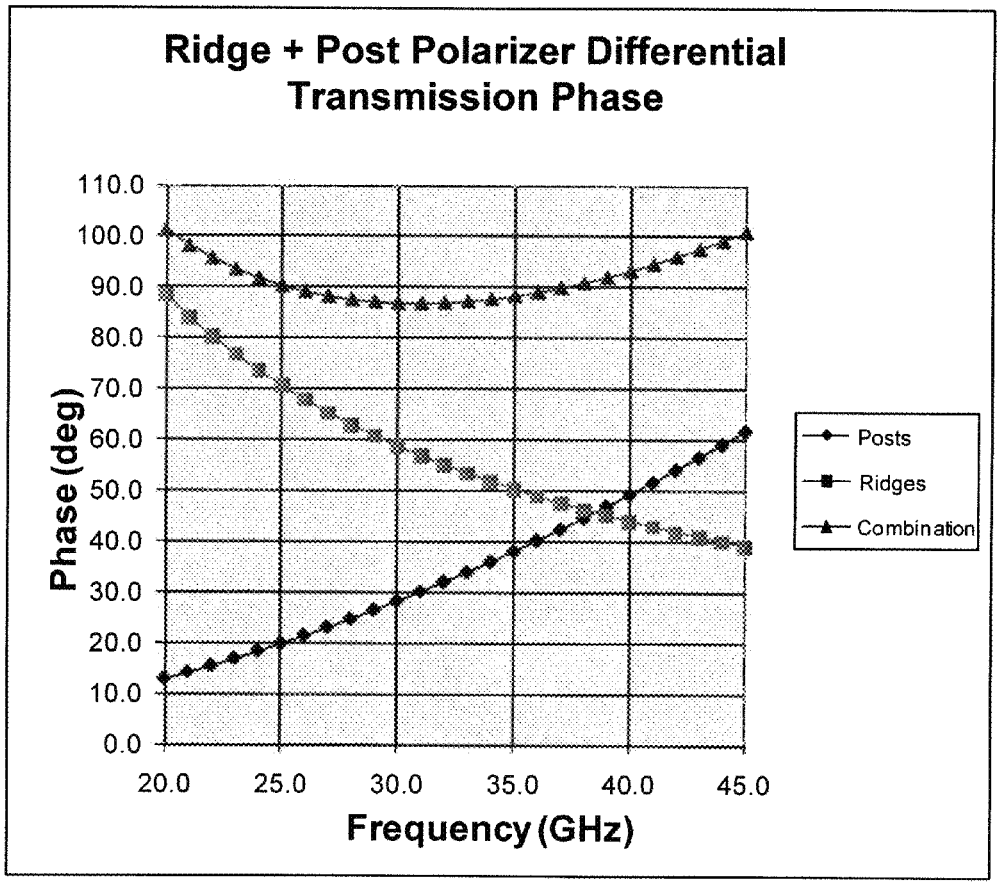
FIG. 4B is a plot of the calculated transmission phase response of the waveguide polarizer of FIG. 4A.

FIG. 4B is a plot of the calculated differential transmission phase between modes 451, 452 within the waveguide polarizer 400 illustrated in FIG. 4A, including the contributions to the differential transmission phase from ridges 421, 422 alone, or from the first and second pluralities of projections 431, 432 alone. As FIG. 4B illustrates, the calculated differential transmission phase for the ridge 421, 422 and waveguide body 410 portions of waveguide polarizer 400 of FIG. 4A (filled squares), decreases monotonically over the frequency range of 20 GHz to 45 GHz. The calculated differential transmission phase for the first and second pluralities of projections 431, 432 (filled diamonds) increases monotonically over the same frequency range. The sum of the two contributions, i.e., the total calculated differential transmission phase for waveguide polarizer 400, can be seen to have little variation over the illustrated frequency range. For example, between the frequencies of about 23 GHz and 41 GHz, the phase deviates from 90 degrees by less than about 5%. Thus, any signal having frequencies within this range would be converted from linear to circular polarization, or circular to linear polarization, with less than about 5% ellipticity, corresponding to a bandwidth of greater than 20%, or greater than 25%, or even greater than 30%. In contrast, as discussed above with respect to FIGS. 1A-2B, slab and ridge polarizers have a significantly narrower bandwidth of about 5%. Note that although the results in FIG. 4B are functions of real frequency (GHz), they can readily be normalized by dividing by the central frequency (here, about 32 GHz), as was done for FIGS. 1B and 2B described above, and FIGS. 5B, 6B, and 7B described below.

As can readily be seen from Equation 1 above, the differential transmission phase depends, among other things, on the product of the number n of projections 430, and the length $l_p$ of projections 430. Based on such a relationship, it can be appreciated that the number n of projections 430 may be reduced proportionally as the length $l_p$ of the projections is increased; conversely, the length $l_p$ of projections 430 may be reduced proportionally as the number n of projections is increased. However, the length $l_p$ of projections 430 is preferably less than one quarter of the guide wavelength $\lambda_{gw}$ in the plane parallel to ridges 421, 422, because such a length would correspond to the resonant frequency $f_r$. Moreover, the length of the projections $l_p$ cannot be decreased to zero, which would cause the second term of Equation 1 to vanish, yielding a ridge-only waveguide polarizer such as illustrated in FIG. 2A. Additionally, the efficiency of waveguide polarizer 400 depends, in part, on the spacing between projections 430. For example, if projections 430 are spaced at ¼ of the guide wavelength $\lambda_{gw}$ from one another, reflections from the projections will destructively interfere, yielding a theoretical 100% transmission through the waveguide. However, it may be useful to space projections 430 at less than ¼ of the guide wavelength $\lambda_{gw}$ from one another, enabling a larger number n of projections to be included in waveguide 400 so that the length of the projections may be reduced. As such, the number, length, and spacing of the projections are interdependent parameters that may be selected based on the desired operating wavelength(s) of the waveguide, the desired size of the waveguide, and the desired throughput of the waveguide.

In some embodiments the waveguide polarizer may include four or more, five or more, ten or more, twenty or more, or even fifty or more projections disposed upon each of first and second ridges. For example, the waveguide polarizer may include between four and fifty projections, or between four and forty projections, or between four and thirty projections, or between four and twenty projections, or between four and ten projections, on each of the first and second ridges. For example, the waveguide polarizer may include four, or five, or six, or seven, or eight, or nine, or ten, or eleven, or twelve, or thirteen, or fourteen, or fifteen, or sixteen, or seventeen, or eighteen, or nineteen, or twenty projections, on each of the first and second ridges. In some embodiments, the projections have a length that is less than ¼ of a guide wavelength, e.g., between ¼ and 1/1000, or between ¼ and 1/100, or between ¼ and 1/50, or between ¼ and 1/20, or between ¼ and 1/10, or between ¼ and ⅛, or between ⅛ and 1/1000, or between ⅛ and 1/100, or between ⅛ and 1/50, or between ⅛ and 1/20, or between ⅛ and 1/10, or between 1/16 and 1/1000, or between 1/16 and 1/100, or between 1/16 and 1/50, or between 1/16 and 1/20, of a guide wavelength. In some embodiments, the projections are spaced apart from one another by ¼ of a guide wavelength, or between ¼ and 1/50 of a guide wavelength, e.g., between ¼ and 1/25, or between ¼ and 1/20, or between ¼ and 1/16, or between ¼ and 1/10, or between ¼ and ⅛, or between ¼ and ⅙ of a guide wavelength.

Figure 5A:
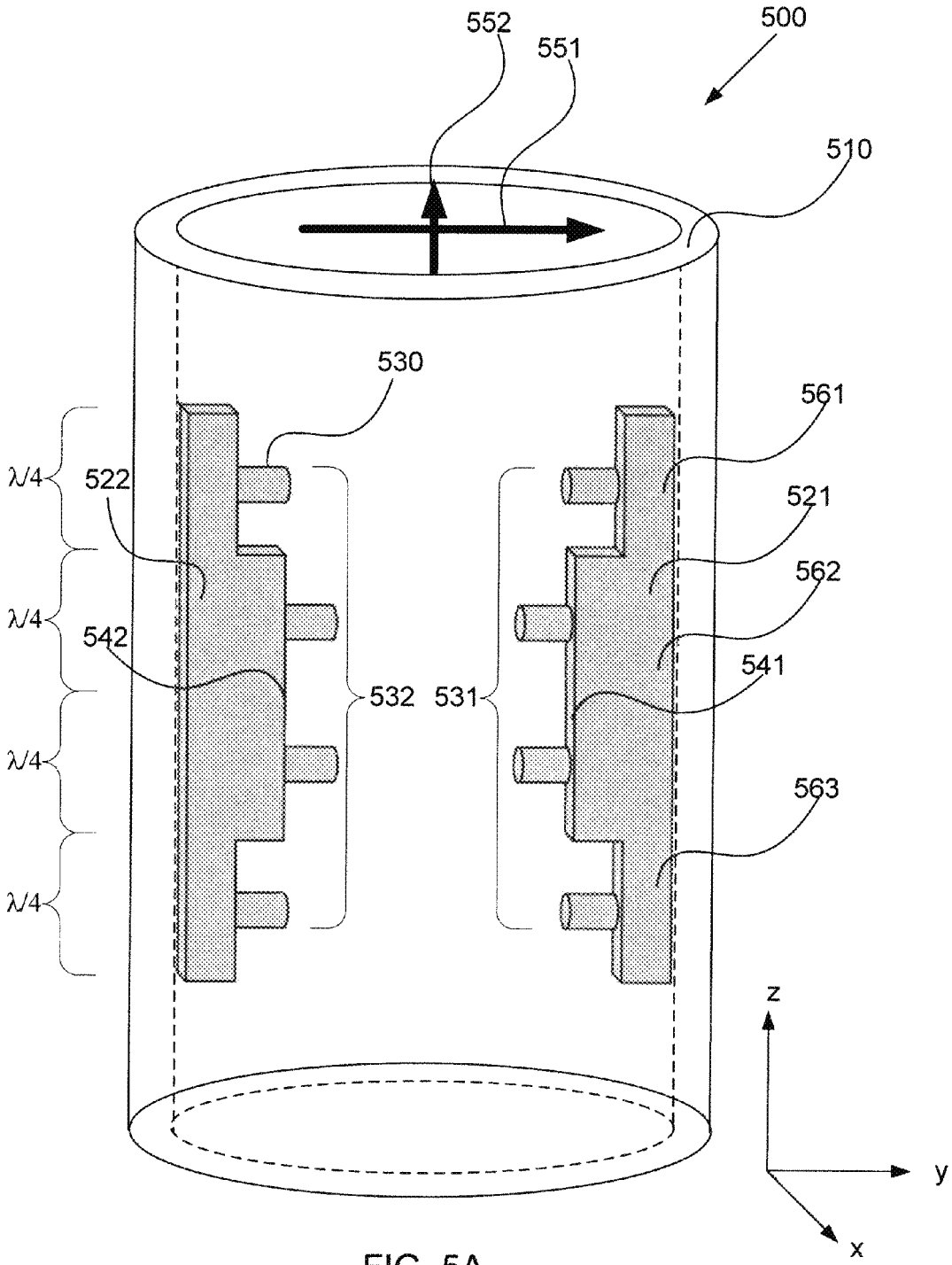
FIG. 5A schematically illustrates a perspective view of an alternative waveguide polarizer, according to some embodiments of the present invention.

For example, FIG. 5A illustrates waveguide polarizer 500 which includes waveguide body 510, first and second ridges 521, 522, and first and second pluralities of projections 531, 532. Each of the first and second pluralities of projections 531, 532 includes four cylindrically shaped projections 530 respectively disposed on the inward-facing surfaces 541, 542 of first and second ridges 521, 522. In waveguide polarizer 500, each of the pluralities of projections 531, 532 includes four projections 530, whereas waveguide polarizer 400 illustrated in FIG. 4A includes ten projections 430 in each plurality of projections 431, 432. Projections 530 may be constructed so as to have a proportionally greater length $l_p$ than projections 430, thus offsetting the reduced number n of projections 530, as discussed above with respect to Equation 1. As such, waveguide polarizer 500 may be constructed to be of overall shorter length than waveguide polarizer 400, because it need not accommodate as many projections as waveguide polarizer 400 to accomplish a similar phase delay between modes 541, 542 as they propagate through waveguide polarizer 500 as waveguide polarizer 400 provides. Additionally, projections 530 may in some embodiments have a width that is narrower than a width of ridges 521, 522.

As illustrated in FIG. 5A, ridges 521, 522 each additionally include first, second, and third steps 561, 562, 563 of varying heights. In one embodiment, steps 561, 563 each have a length of ¼ of the guide wavelength in the plane parallel to the steps, and step 562 has two "segments," each of which has a length of ¼ of the guide wavelength in the plane parallel to the steps, so that ridges 521 and 522 each have a length that is approximately equal to the guide wavelength, e.g., approximately equal to a wavelength of a mode supported by waveguide body 510. One projection 530 is positioned on each of steps 561, 563 and on each of the two segments of step 562, so that the projections 530 are spaced at intervals of ¼ of the guide wavelength from one another. Such an arrangement may enable the ridge/projection assemblies to provide the desired 90-degree polarization rotation over the span of a single guide wavelength, enabling the waveguide polarizer to be significantly more compact than is possible for prior art waveguide polarizers such as those described above. Waveguide body 510 may have a length that is approximately as long as ridges 521, 522, or alternatively may have a length that is longer than ridges 521, 522, as is illustrated. In one embodiment, waveguide body 510 is slightly longer than ridges 521, 522, e.g., at least about 5% longer than the ridges.

It will be appreciated that ridge/projection assemblies such as illustrated in FIG. 5A are optional, and may in some circumstances enhance the efficiency of a waveguide polarizer. The height of ridges 521, 522 may vary along the length of the ridges in ways other than that illustrated; for example, the height may vary smoothly along the length. Or, a greater number of discrete steps may be used. Additionally, the widths of the steps may be different from one another, e.g., the width of ridges 521, 522 may vary along the length. In other embodiments, ridges 521, 522 may have a substantially uniform width along their length. Projections 530 may in some embodiments have the same length as one another, while they may have different lengths from one another in other embodiments. Other configurations are possible, for example as described below with respect to FIGS. 11A-11C.

Figure 5B:
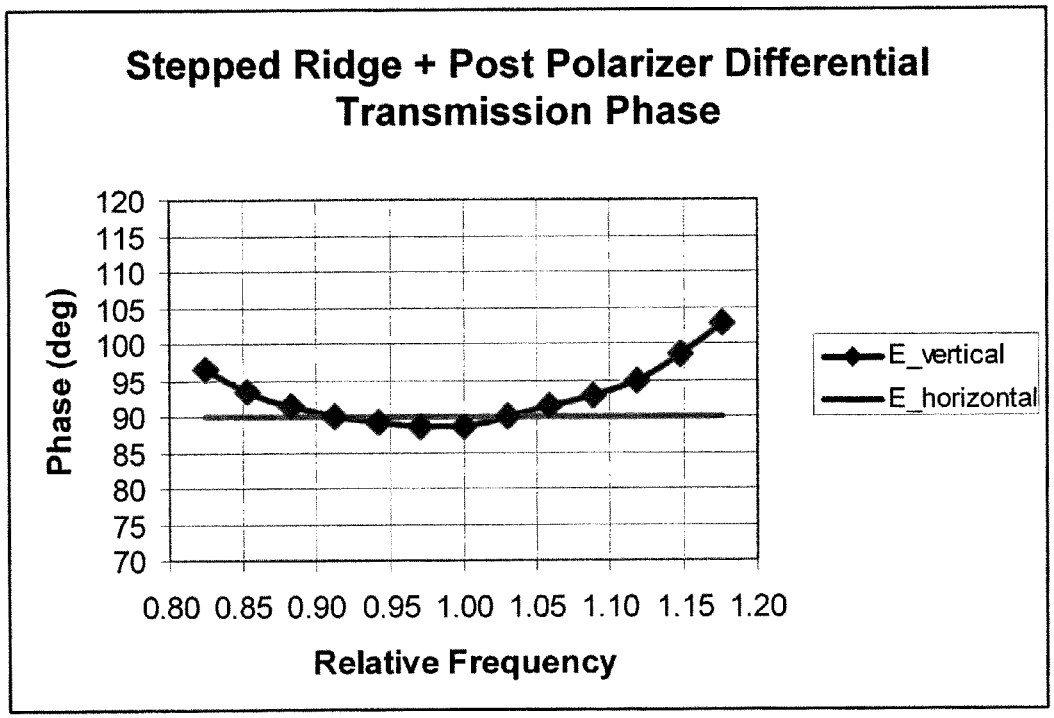
FIG. 5B is a plot of the calculated transmission phase response of the waveguide polarizer of FIG. 5A.

As can be seen from FIG. 5B, the relative phase difference that waveguide polarizer 500 induces in orthogonal fields 551, 552 is substantially independent of bandwidth (e.g., varies from ninety degrees by about 5 degrees or less) between normalized frequencies of about 0.84 and 1.12, corresponding to a relative bandwidth of greater than 30%, significantly higher than available with the prior art waveguide polarizers described above with reference to FIGS. 1A-3.

Figure 6A:
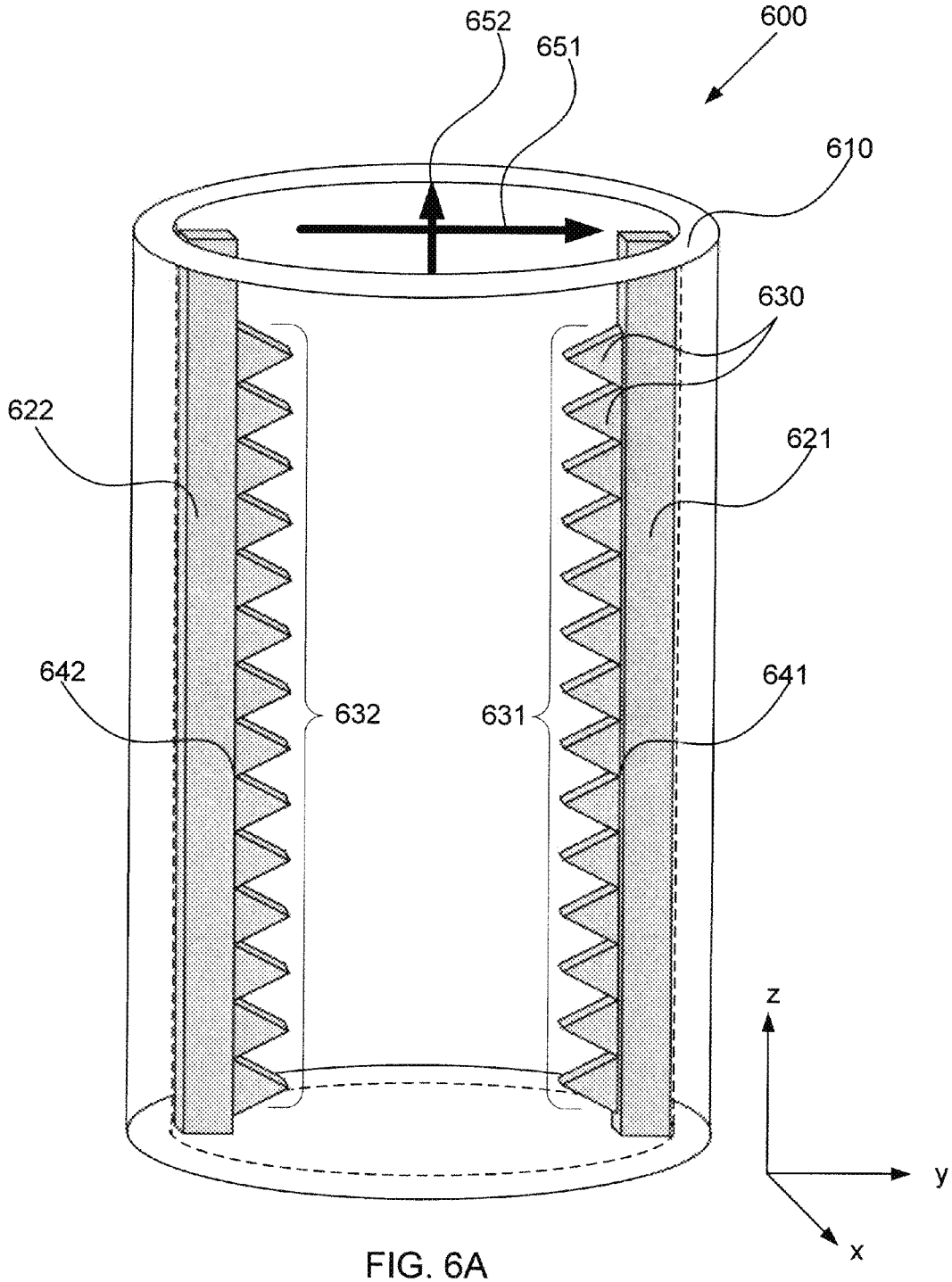
FIG. 6A schematically illustrates a perspective view of another alternative waveguide polarizer, according to some embodiments of the present invention.
Figure 6B:
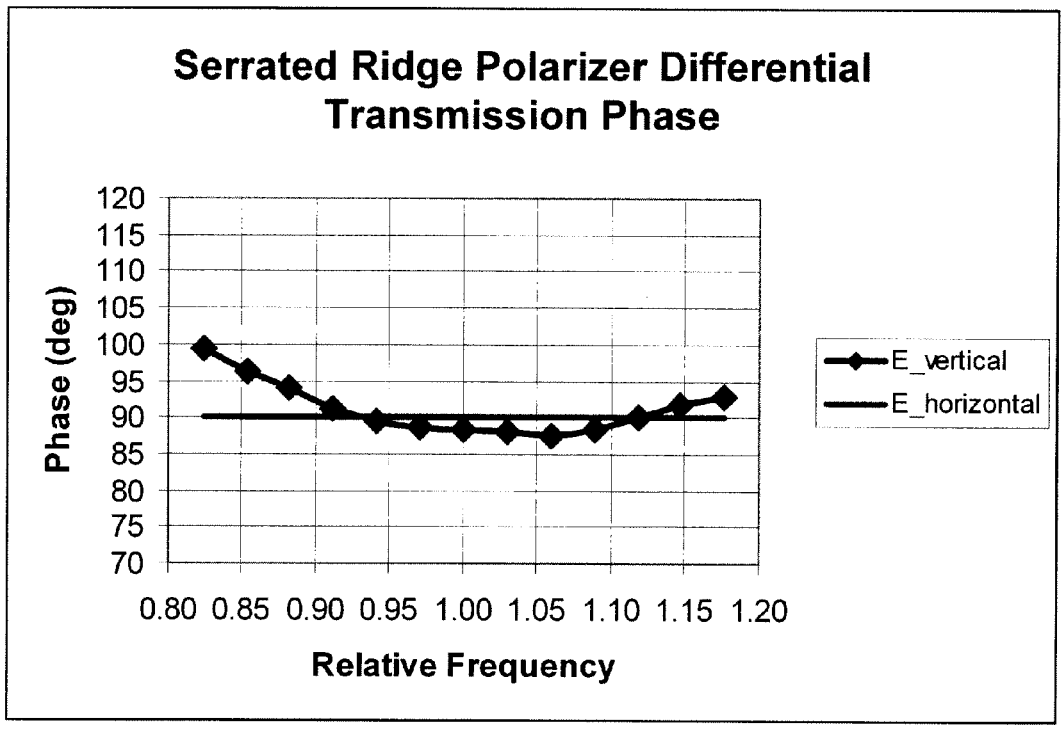
FIG. 6B is a plot of the calculated transmission phase response of the waveguide polarizer of FIG. 6A.

FIG. 6A schematically illustrates alternative waveguide polarizer 600 that includes waveguide body 610, first and second ridges 621, 622, and first and second pluralities of projections 631, 632. Each of the pluralities of projections 631, 632 includes fourteen serrated projections 630 respectively disposed on the inward-facing surfaces 641, 642 of first and second ridges 621, 622. Each projection 630 is triangularly shaped. In the illustrated embodiment, ridges 621, 622 have uniform height along their length, although as noted elsewhere the ridges may alternatively include steps or otherwise have a varying height and/or width along their length. Additionally, projections 630 may vary in length and/or width along ridges 621, 622. In the illustrated embodiment, projections 630 have a width that is narrower than a width of ridges 621, 622, which in some circumstances may enhance the bandwidth performance of waveguide polarizer 600 as compared to an embodiment in which the width of projections 630 was the same as the width of ridges 621, 622. As discussed above, the particular number and length of projections, and the parameters of the ridges, in a given waveguide polarizer may be selected based on the operating requirements of the waveguide polarizer. FIG. 6B is a plot of the calculated differential transmission phase for waveguide polarizer 600 illustrated in FIG. 6A, as a function of normalized frequency. As can be seen from FIG. 6B, the relative phase difference that waveguide polarizer 600 induces in orthogonal fields 651, 652 is substantially independent of bandwidth (e.g., varies from 90 degrees by about 5 degrees or less) between normalized frequencies of about 0.88 and 1.17, corresponding to a relative bandwidth of greater than 30%, significantly higher than available with the prior art waveguide polarizers described above with reference to FIGS. 1A-3.

Figure 7A:
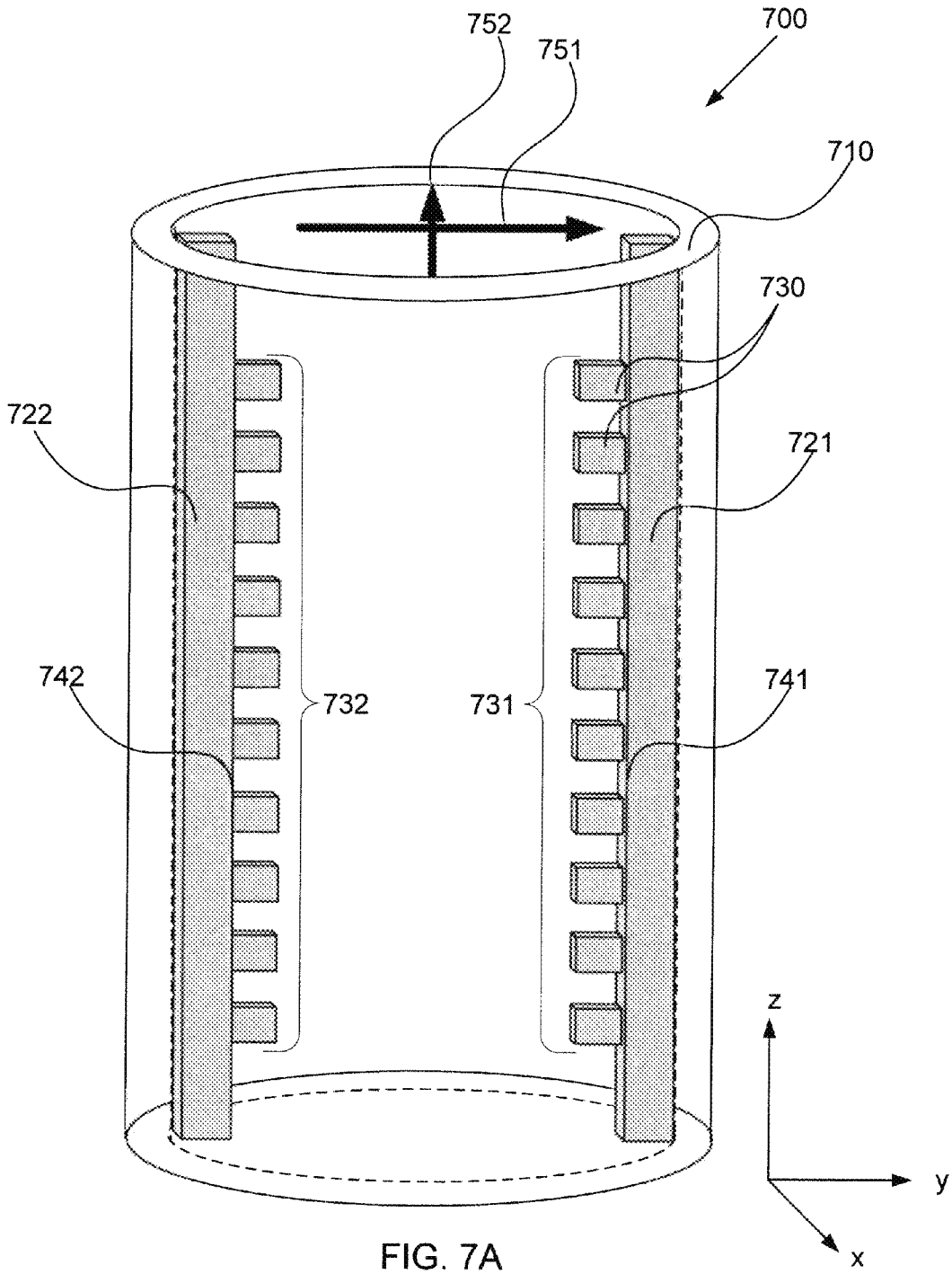
FIG. 7A schematically illustrates a perspective view of another alternative waveguide polarizer, according to some embodiments of the present invention.
Figure 7B:
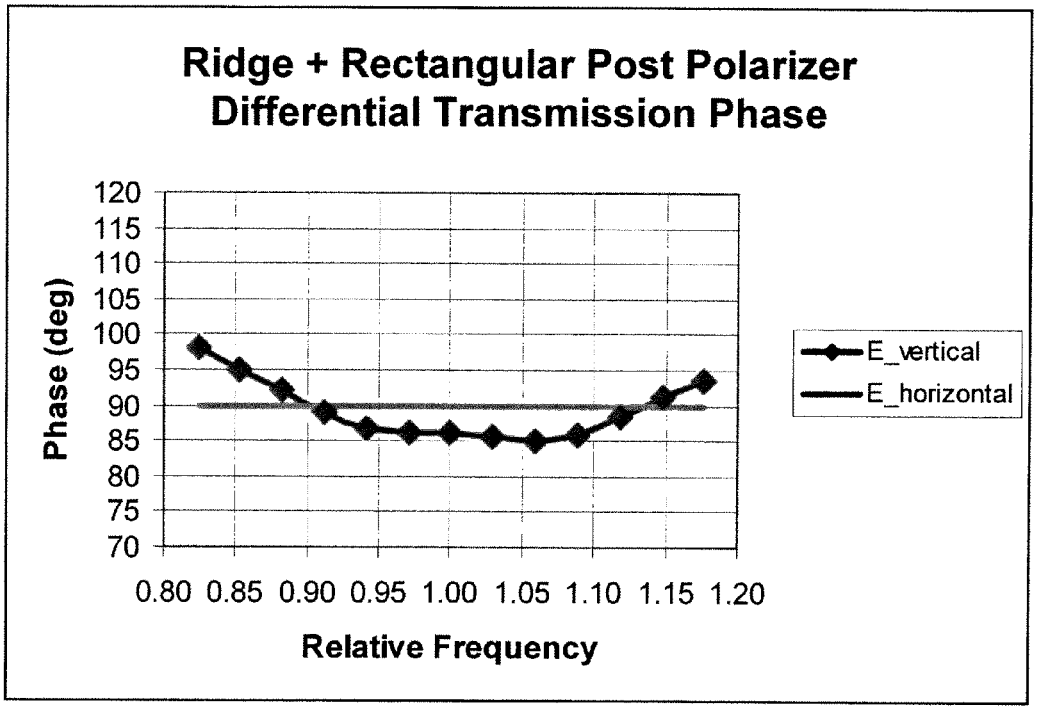
FIG. 7B is a plot of the calculated transmission phase response of the waveguide polarizer of FIG. 7A.

FIG. 7A schematically illustrates alternative waveguide polarizer 700 that includes waveguide body 710, first and second ridges 721, 722, and first and second pluralities of projections 731, 732. Each of the pluralities of projections 731, 732 includes eight projections 730 respectively disposed on the inward-facing surfaces 741, 742 of first and second ridges 721, 722. Each projection 730 is a rectangularly shaped post that has a width that is narrower than a width of ridges 721, 722. In the illustrated embodiments, ridges 721, 722 have uniform height along their length, as well as a uniform width along their length. As discussed above, the particular number and length of projections, and the parameters of the ridges, in a given waveguide polarizer may be selected based on the operating requirements of the waveguide polarizer. FIG. 7B is a plot of the calculated differential transmission phase for waveguide polarizer 700 illustrated in FIG. 7A, as a function of normalized frequency. As can be seen from FIG. 7B, the relative phase difference that waveguide polarizer 700 induces in orthogonal fields 751, 752 is substantially independent of bandwidth between normalized frequencies of about 0.86 and 1.17, corresponding to a relative bandwidth of greater than 30%, significantly higher than available with the prior art waveguide polarizers described above with reference to FIGS. 1A-3.

Methods of Making

Figure 8:
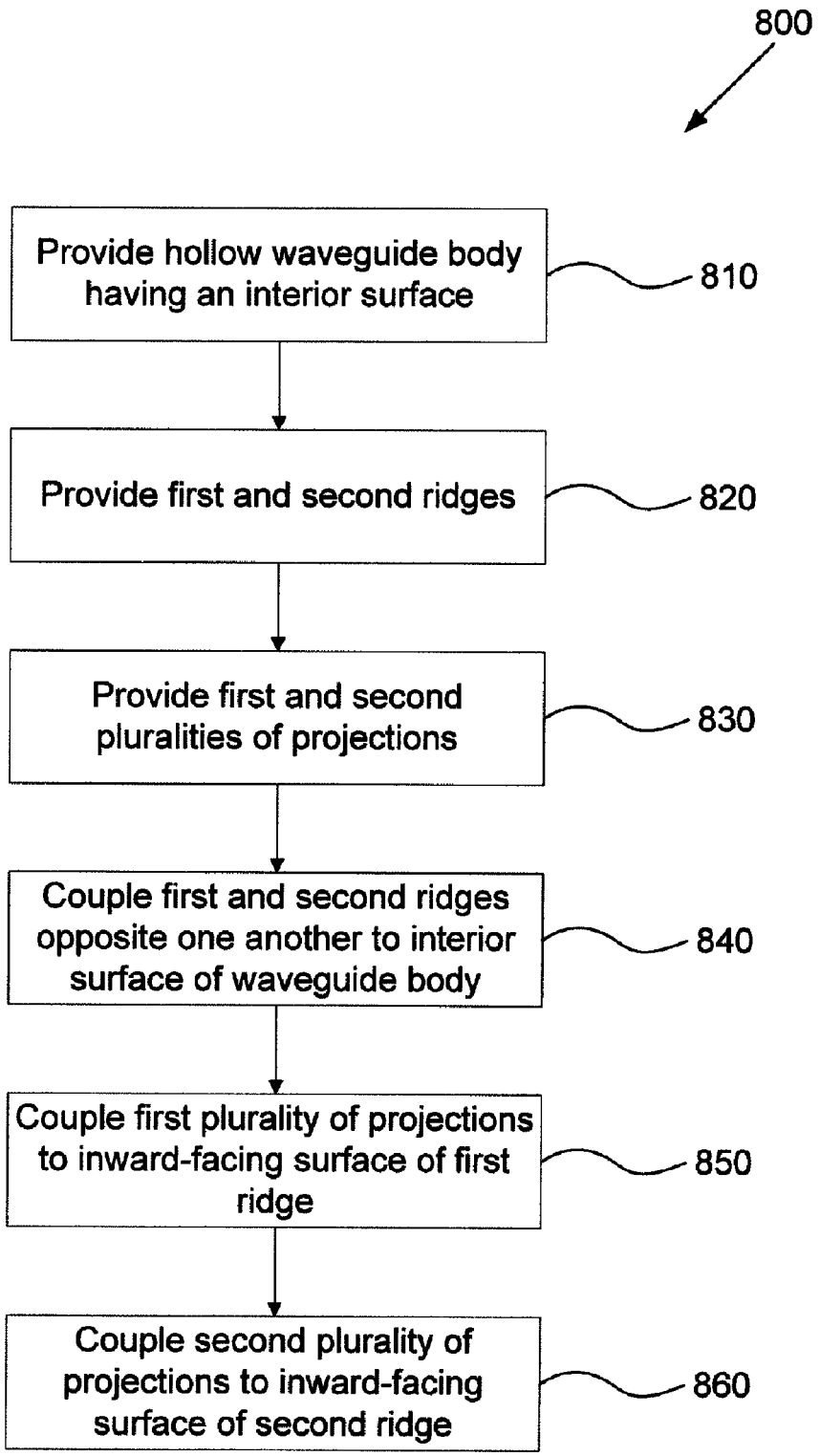
FIG. 8 illustrates steps in a method of making a waveguide polarizer, according to some embodiments of the present invention.

FIG. 8 illustrates a method 800 of making a waveguide polarizer, according to some embodiments of the present invention. As will be apparent, the steps of method 800 need not necessarily be performed in the order in which they are described. Additionally, as described below, some embodiments may include only one ridge/projection assembly, or may include more than two such assemblies. Method 800 may be readily modified based on the number of ridge/projection assemblies to be included in the waveguide polarizer being made.

Method 800 includes providing a hollow waveguide body having an interior surface (810). The diameter of the waveguide body is preferably sufficiently large so as to support two orthogonal linear modes of the wavelength of interest therein, and the length of the waveguide body is preferably sufficiently large such that one of the two orthogonal modes may accumulate the desired phase delay as it propagates therethrough. Preferably, the waveguide body has a symmetrical cross-section. For example, the waveguide body may have a circular cross-section. In other embodiments, the waveguide body may have an elliptical cross-section, or a rectangular cross-section, or a square cross-section. The waveguide body may be formed using any suitable method, for example, by machining, or extrusion, or die-casting. Portions of the waveguide body may be separately formed and subsequently secured together, for example using an adhesive, or a latching mechanism, or with welding. The hollow waveguide body may be formed of a conductor, such as a metal. Examples of suitable metals include aluminum, magnesium, zinc, titanium, or steel, which optionally may be coated with another conductor, e.g., with chromium, gold, platinum, or silver. In one embodiment, the waveguide body is formed of aluminum.

Method 800 also includes providing first and second ridges (820). As discussed above with reference to FIGS. 4A-5B, the ridges may have a uniform height along their length, or alternatively may have a height that varies along the length (e.g., smoothly, or in steps of different heights). The ridges may be unitary with the waveguide body, in which case they are formed concurrently with the waveguide body. Alternatively, the ridges may be formed separately from the waveguide body, using any suitable method. For example, the ridges may be formed by machining, or extrusion, or die-casting. The ridges may be formed of a conductor, such as a metal. Examples of suitable metals include aluminum, magnesium, zinc, titanium, or steel, which optionally may be coated with another conductor, e.g., with chromium, gold, platinum, or silver. In one embodiment, the ridges are formed of aluminum. In one embodiment, the ridges and waveguide body are formed concurrently by die-casting two halves of the ridge/waveguide body assembly, and then securing the two halves together with welding.

Method 800 also includes providing first and second pluralities of projections (830). The projections may be unitary with the ridges (which in turn may be unitary with the waveguide body). Alternatively, the projections may be formed separately from the ridges, using any suitable method. For example, the projections may be formed by machining, or extrusion, or die-casting. The projections may be formed of a conductor, such as a metal. Examples of suitable metals include aluminum, magnesium, zinc, titanium, or steel, which optionally may be coated with another conductor, e.g., with chromium, gold, platinum, or silver. In one embodiment, the projections are formed of aluminum. In one embodiment, the projections are formed as self-tapping or machine screws formed of steel, which is optionally coated with chromium or gold.

Method 800 also includes coupling the first and second ridges opposite one another to the interior surface of the waveguide body (840). In embodiments where the ridges and waveguide body are unitary with one another, such coupling occurs during the formation of the ridge/waveguide body structure. In embodiments where the ridges are formed separately from the waveguide body, the ridges may be coupled to the waveguide body using any suitable method, for example with an adhesive, or a latching mechanism, or with welding.

Method 800 also includes coupling the first plurality of projections to an inward-facing surface of the first ridge (850), and coupling the second plurality of projections to an inward-facing surface of the second ridge (860). In embodiments where the projections and ridges are unitary with one another, such coupling occurs during the formation of the projection/ridge structure. In such embodiments, the length of the projections are fixed during their formation. In other embodiments, where the projections and ridges are formed separately from one another, the projections may be coupled to the ridges using any suitable method, such as with an adhesive, or a latching mechanism, or with welding. For example, a series of cavities may be defined in the inward-facing surfaces of ridges, and the projections inserted into the cavities. The projections may be held in place via friction, or may be secured using any suitable mechanism. For example, the cavities may be threaded, and the projections may be screws that are threaded to match the threads of the cavities. Or, for example, the cavities may be smooth, and the projections may be screws that create their own threads as turned. Or, for example, the projections may be screws that are self-tapping, obviating the need to form cavities in the ridges. In embodiments in which the projections are screwed or otherwise inserted into the ridges, their length relative to the ridge may be tunable, and the depth to which the projections are screwed or inserted into the ridges may be based on a phase delay to be induced in a mode propagating parallel to the ridges relative to a mode propagating perpendicular to the ridges, e.g., as discussed above with reference to Equation 1.

Methods of Use

The waveguide polarizers of the present invention may be incorporated into a wide variety of systems. For example, circularly polarized signals are generally preferred for transmitting and receiving signals to and from satellite systems, because circular polarization obviates the need to align the ground-based antennas with that of the satellite antenna, as may be required for linearly polarized signals. This is especially true when used with Earth terminals that are mobile, viewing multiple satellites, or when the space segment is not in a geostationary orbit, causing the orientation of a linear polarized signal to constantly change. However, signal processing performed terrestrially or on a satellite is typically performed using linearly polarized waves, requiring the use of a waveguide polarizer to convert the circularly polarized received/transmitted signal into a linearly polarized signal for processing. Additionally, to achieve high-capacity links, some systems encode different signals in both of the linear components of the circularly polarized waves, requiring high-polarization purity over the entire band of operation. When used in phased arrays that have large element counts, size and weight of the components in the antenna are also important parameters.

Various embodiments of the inventive waveguide polarizers may be employed as an interface between a circularly polarized antenna, e.g., a phased-array antenna or reflector antenna, and signal processing components, e.g., linearly polarized filters, amplifiers, and beam-formers. Because the waveguide polarizers are characterized by high bandwidth, low loss, compact form, durability, low residual ellipticity, and ease of manufacture, they are more suitable for use in such environments than the prior art polarizers discussed above, which may have too narrow a bandwidth, high sensitivity to environmental conditions, low reproducibility, high residual ellipticity, and/or too high of loss to meet the desired performance requirements. The inventive waveguide polarizers may be used both in ground-based systems and in satellite-based systems, to convert circularly polarized transmitted and/or received signals into linearly polarized signals for processing.

Figure 9A:
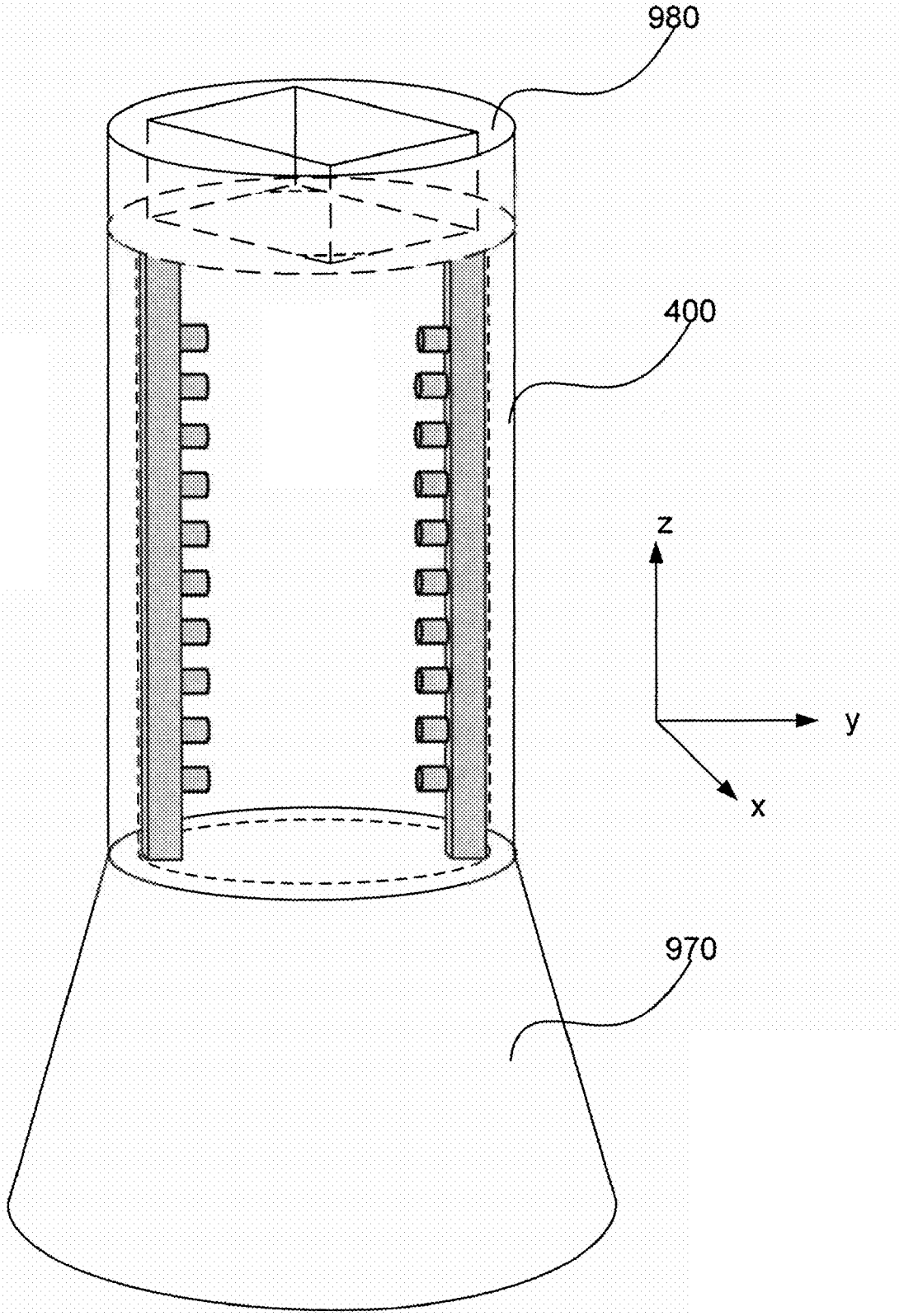
FIGS. 9A and 9B respectively schematically illustrate perspective and plan views of the waveguide polarizer of FIG. 4A coupled to a rectangular waveguide and a feedhorn, according to some embodiments of the present invention.
Figure 9B:
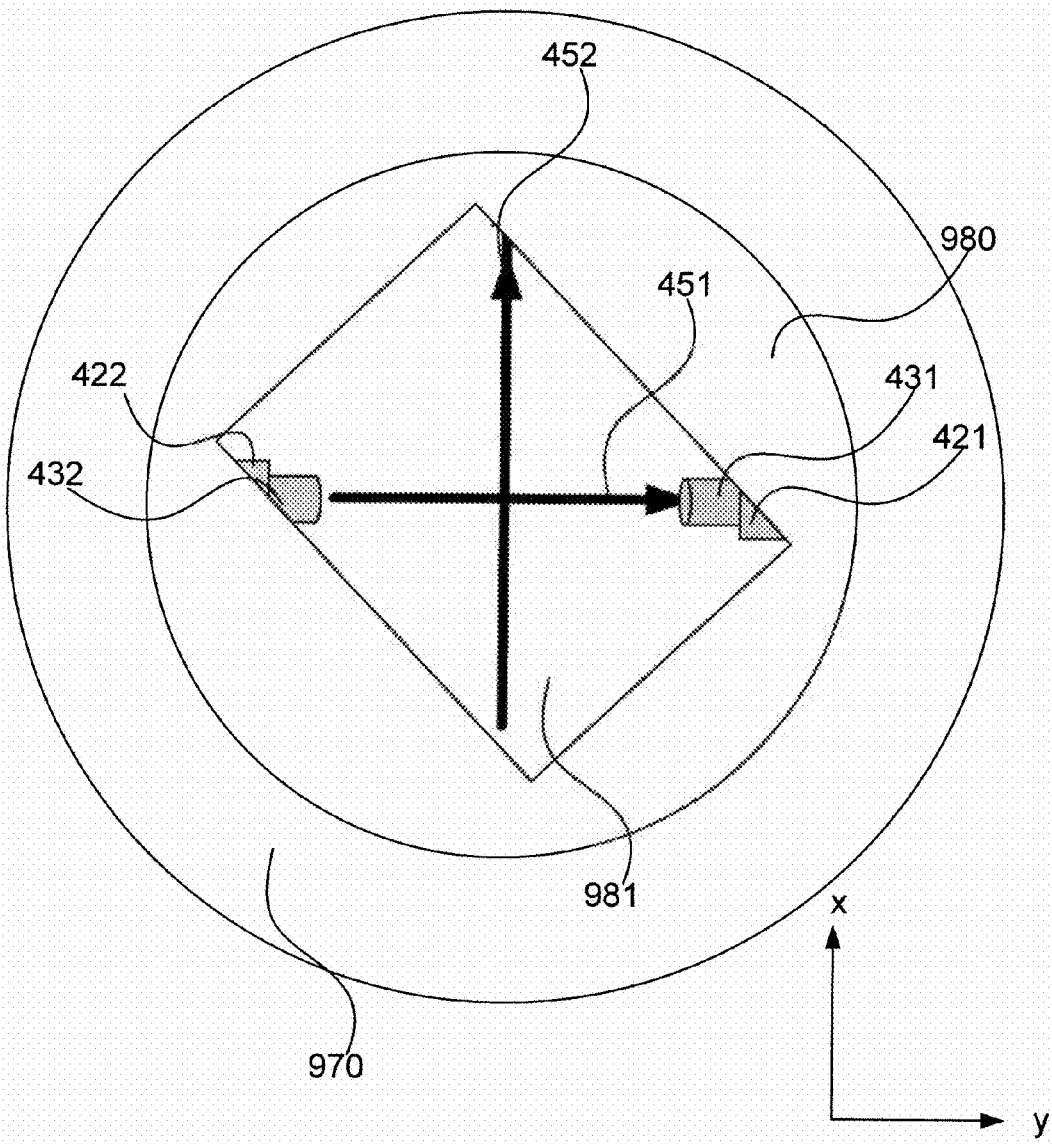

For example, FIGS. 9A-9B illustrate perspective and plan views of an embodiment in which waveguide polarizer 400 of FIG. 4A is coupled to conical feedhorn 970 and to rectangular waveguide 980. Assembly 400, 970, 980 may be positioned, for example, in a satellite, an airplane, or in a ground-based system, which may be mobile or may be fixed. Assembly 400, 970, 980 may be used alone, may be part of a phased array incorporating a plurality of such assemblies, or may be part of a reflector antenna. In some embodiments, waveguide polarizer 400 is coupled to waveguide 980, and feedhorn 970 is omitted. In other embodiments, waveguide polarizer 400 is coupled to feedhorn 970, and waveguide 980 is omitted. In some embodiments, both the satellite and the airplane or ground-based system include assembly 400, 970, 980.

Conical feedhorn 970 is configured to receive circularly polarized signals of both senses (LHCP and RHCP), and may be constructed using any design and materials known in the art. Those of skill in the art will recognize that in embodiments in which waveguide polarizer has a cross-section that is not circular, e.g., that is rectangular, feedhorn 970 may be constructed to have a shape that is other than conical, e.g., rectangular, to more efficiently feed waves into waveguide polarizer 400.

Waveguide polarizer 400 is configured to receive a circularly polarized signal from conical feedhorn 970, and is configured to induce an approximately 90 degree phase delay in that signal, e.g., as described above, to provide a linearly polarized signal. Rectangular waveguide 980 is configured to receive that linearly polarized signal, and to transmit that signal to other components, such as a filter. As illustrated in FIG. 9B, aperture 981 of rectangular waveguide 980 may be positioned at a 45 degree angle with respect to the first and second ridges 421, 422 and first and second pluralities of projections 431, 432 of waveguide polarizer 400. The 45 degree angle allows the incident field to be split between orthogonal modes 451, 452, which propagate along waveguide 980 for processing by other components. In embodiments where assembly 400, 970, 980 receives a signal having substantially only a single sense of circular polarization, waveguide 980 receives a signal having substantially only a single linear polarization. In embodiments where assembly 400, 970, 980 receives a signal having both senses of circular polarization, each of which senses contains different information, waveguide 980 receives a signal having two linearly polarized orthogonal modes, each of which contains different information.

Assembly 400, 970, 980 may also transmit signals. For example, waveguide polarizer 400 may receive a linearly polarized signal from waveguide 980, may convert that signal to a circularly polarized signal, and may provide that circularly polarized signal to feedhorn 970 for transmission.

Alternative Embodiments

Figure 10A:
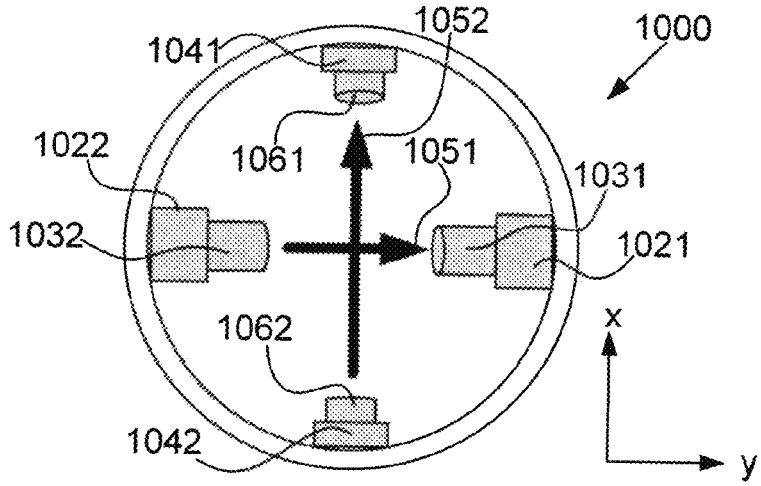
FIGS. 10A-10C schematically illustrate plan views of alternative embodiments of waveguide polarizers.

Although the above-described embodiments include a single pair of ridge/projection assemblies, other configurations are possible. For example, as illustrated in FIG. 10A, waveguide polarizer 1000 may include a first pair of ridges 1021, 1022 with pluralities of projections 1031, 1032 respectively disposed thereon, and a second pair of ridges 1041, 1042 with pluralities of projections 1061, 1062 respectively disposed thereon. In one embodiment, the projections of the pluralities 1031, 1032 have the same length as one another, but a different length than the projections of the pluralities 1061, 1062. The widths of any or all of the projections may be narrower than the widths of the respective ridges on which they are disposed. Additionally, the pair of ridges 1021, 1022 may have the same height and width as one another, but a different height and/or width than the pair of ridges 1041, 1042. In the illustrated embodiment, ridges 1021, 1022 have a greater height than ridges 1041, 1042, and the same width. Alternatively, any of the ridges may have different heights and/or widths from any or all of the other ridges, and any of the pluralities of projections may have different lengths and/or widths than any or all of the other pluralities of projections. The different heights and/or widths of the ridge pairs and/or the different lengths and/or widths of the pluralities of projections may induce different phase delays in orthogonal modes 1051, 1052 as the modes propagate along waveguide 1000.

Figure 10B:
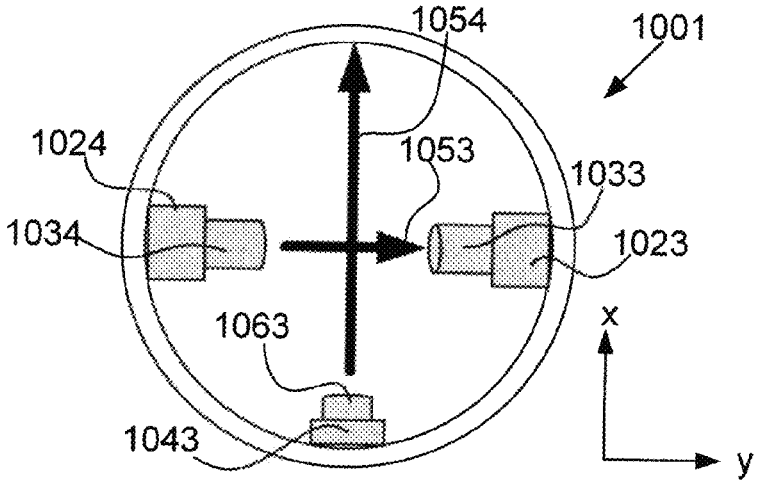

Alternatively, as illustrated in FIG. 10B, waveguide polarizer 1001 may include a pair of ridges 1023, 1024 with pluralities of projections 1033, 1034 respectively disposed thereon, and a single ridge 1043 with a plurality of projections 1063 disposed thereon. In one embodiment, the projections of the pluralities 1033, 1034 have the same length as one another, but a different length than the projections of plurality 1063. Additionally, the pair of ridges 1033, 1034 may have the same height and width as one another, but a different height and/or width than ridge 1043. In the illustrated embodiment, ridges 1023 and 1024 have a greater height than ridge 1043, but the same width. Alternatively, any of the ridges may have different heights and/or width from any or all of the other ridges, and any of the pluralities of projections may have different lengths and/or widths than any or all of the other pluralities of projections. In some embodiments, the projections have a narrower width than the ridge on which they are respectively disposed. The different internal dimensions of waveguide 1001 in the planes respectively parallel to modes 1053, 1054 provided by the different heights of the ridges, the different lengths of the pluralities of projections, and/or the absence of a ridge opposite ridge 1043 may induce different phase delays in modes 1053, 1054 as those modes propagate along waveguide 1001.

Figure 10C:
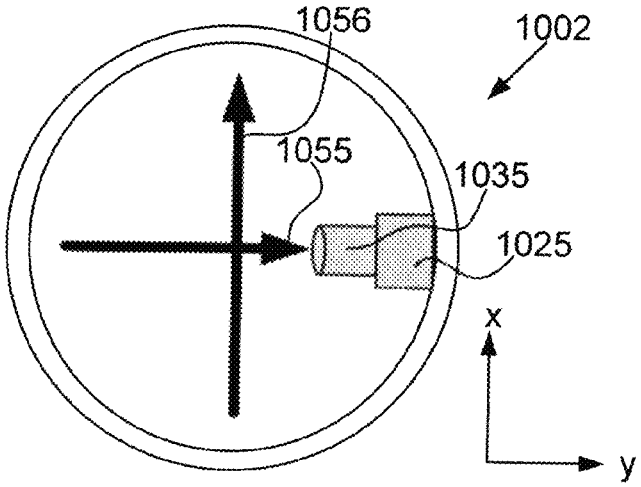

Alternatively, as illustrated in FIG. 10C, waveguide polarizer 1002 may include a single ridge 1025 with a plurality of projections 1035 disposed thereon. The different internal dimensions of waveguide 1002 in the planes respectively parallel to modes 1055, 1056 provided by ridge 1025, projections 1035 may induce different phase delays in orthogonal modes 1055, 1056 as the modes propagate along waveguide 1002.

Any suitable number of ridge/projection assemblies may be provided within a waveguide polarizer, according to various embodiments of the present invention. For example, as illustrated in FIGS. 4A-10C, waveguide polarizers may have one, or two, or three, or four ridge/projection assemblies disposed within a waveguide body. Alternatively, waveguide polarizers may have more than four ridge/projection assemblies disposed within a waveguide body, for example, five, or six, or seven, or eight, or nine, or ten, or more than ten ridge/projection assemblies. Additionally, the ridge/projection assemblies may have any suitable configuration, and need not be limited to the uniform ridge/cylindrical projection embodiments illustrated in FIGS. 10A-10C. For example, the ridges may have a uniform height, or may have a height that varies along the ridge length, e.g., smoothly or stepwise, and/or may have a width that varies along the ridge length, e.g., smoothly or stepwise. Or, for example, the projections may be cylindrical, rectangular, square, or serrations. Any suitable combination of ridge shape and projection shape may be used, including shapes not specifically described herein.

Figure 11A:
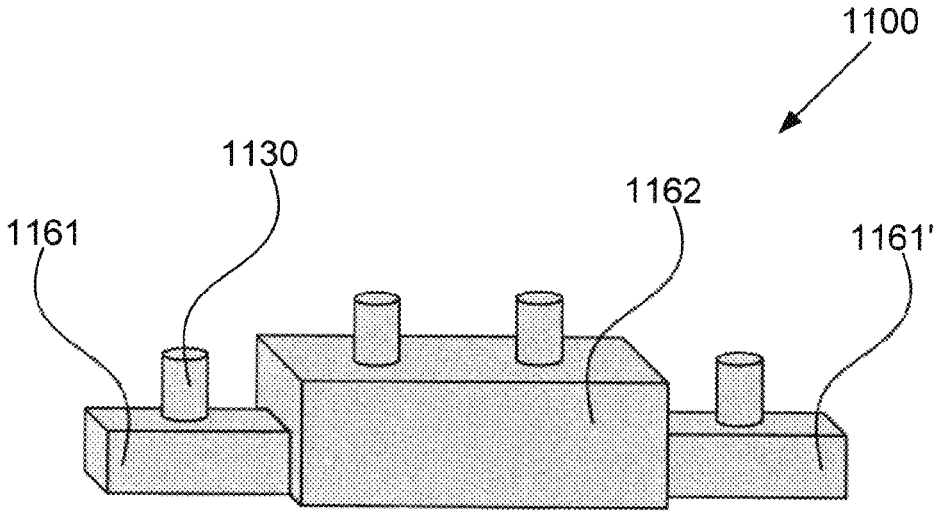
FIGS. 11A-11B schematically illustrate perspective views of alternative ridge/projection assemblies that may be used in a waveguide polarizer, according to some embodiments of the present invention.
Figure 11B:
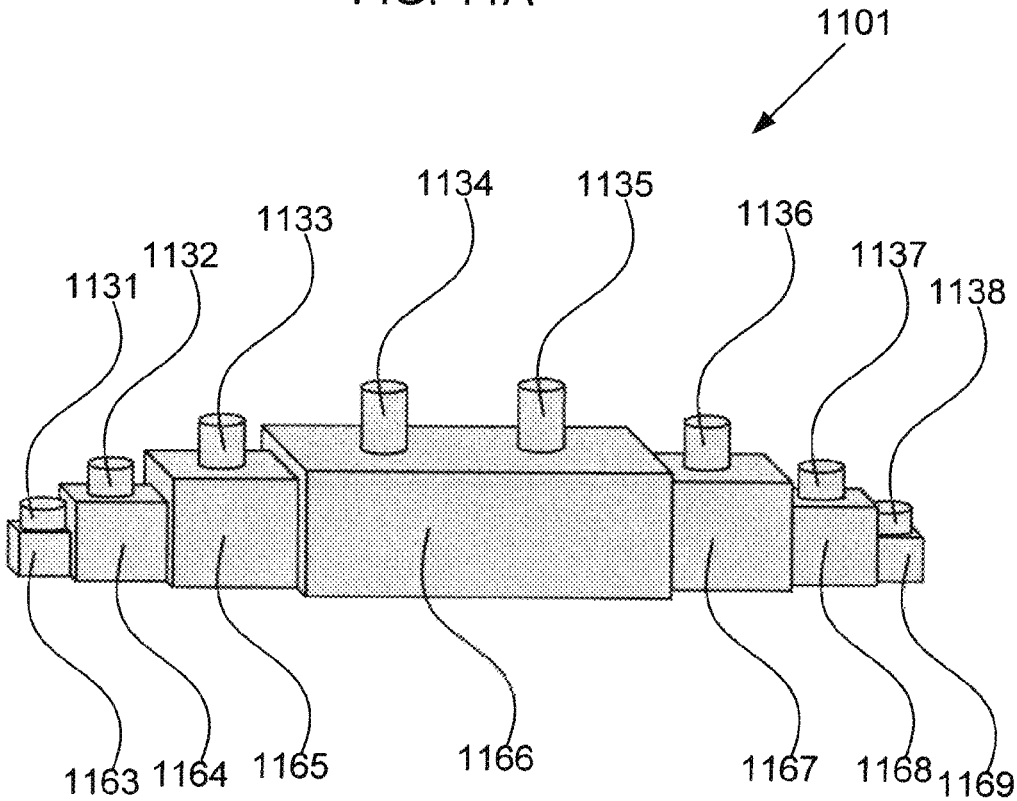
Figure 11C:
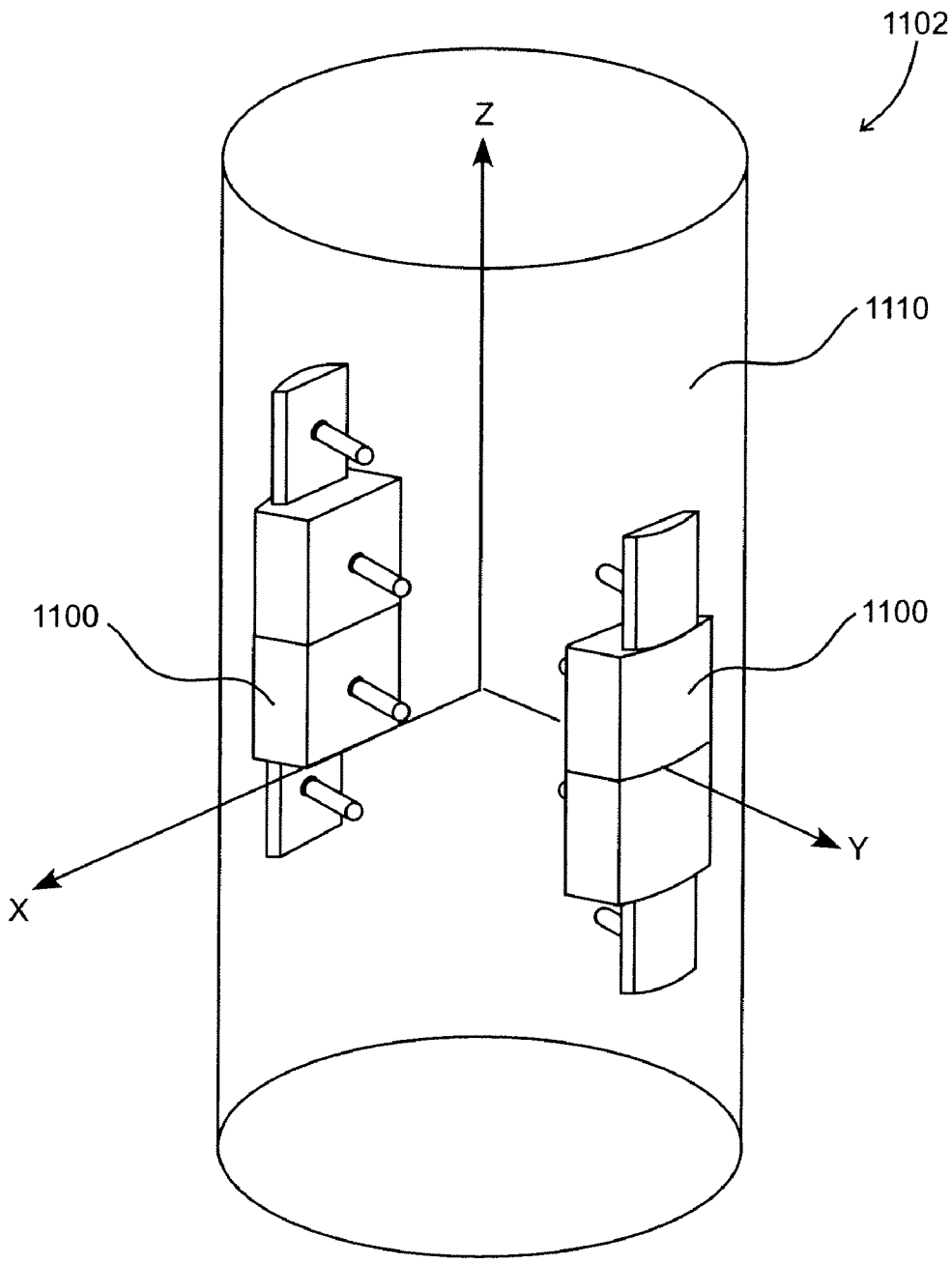
FIG. 11C schematically illustrates a perspective view of a waveguide polarizer including a pair of the ridge/projection assemblies illustrated in FIG. 11A, according to some embodiments of the present invention.

As discussed above with reference to ridges 521, 522 illustrated in FIG. 5A, in some embodiments the width of the ridges may vary along their length. For example, FIG. 11A illustrates ridge/projection assembly 1100 that may be used in place of ridges 521, 522. Ridge 1100 includes steps 1161 and 1161' that have lengths of ¼ of the guide wavelength and step 1162 that has a length of ½ of the guide wavelength, which may be thought of as having two segments that are each ¼ of the guide wavelength as discussed above with respect to FIG. 5A. A projection 1130 is disposed on each of steps 1161 and 1161', and on each segment of step 1162, so there are two projections 1130 disposed on step 1162. Projections 1130 have a width that is narrower than the step on which they are respectively disposed, and in the illustrated embodiment, have the same length as one another, although alternatively at least one projection 1130 may have a different length than at least one other projection 1130. Steps 1161, 1161' are not only shorter than step 1162 (have a reduced height relative to step 1162) but also have a reduced width. Varying both the width and the height of steps 1161, 1161' may in some circumstances enhance the bandwidth of a waveguide polarizer incorporating ridge/projection assembly 1100, as well as reduce the number of higher-order modes excited within the waveguide polarizer. FIG. 11C illustrates a perspective view of waveguide polarizer 1102 that includes first and second ridge/projection assemblies 1100 disposed opposite one another on the inner surface of waveguide body 1110. Note that the wall of waveguide body 1110 is omitted for clarity from FIG. 11C.

The provision of additional steps of varying heights and/or widths may further enhance the performance of a waveguide polarizer. For example, FIG. 11B illustrates ridge/projection assembly 1101 that may be used in place of ridges 521, 522, and that includes steps 1163, 1164, . . . 1169 having projections 1131, 1132, . . . 1138 respectively disposed thereon, with two projections disposed on central step 1166. Assembly 1101 is arranged substantially symmetrically, with steps 1163 and 1169 being about the same height and width as one another; steps 1164 and 1168 being about the same height and width as one another, and being taller and wider than steps 1163 and 1169; steps 1165 and 1167 being about the same height and width as one another, and being taller and wider than steps 1164 and 1168; and step 1166 being taller, wider, and longer than steps 1165 and 1167. The projections have substantially the same width as one another, which width is narrower than the width of any of the steps in assembly 1101. However, at least some of the projections have different lengths from each other. Specifically, projections 1131 and 1138 are about the same length as one another; projections 1132 and 1137 are about the same length as one another and are longer than projections 1131 and 1138; projections 1133 and 1136 are about the same length as one another and are longer than projections 1132 and 1137; and projections 1134 and 1135 are about the same length as one another and are longer than projections 1133, 1136. Varying both the width and the height of the various steps and projections may in some circumstances enhance the bandwidth of a waveguide polarizer incorporating ridge/projection assembly 1100, as well as reduce the number of higher-order modes excited within the waveguide polarizer.

In one illustrative embodiment, a ridge is provided that is similar to that illustrated in FIG. 11B but which contains 15 steps (indexed as 1, 2, . . . 15) that are arranged symmetrically and have the dimensions listed Table 1, and the projections respectively disposed thereon are cylindrical posts (indexed as a, b, . . . o) having the lengths listed in Table 2.

TABLE 1

Step Dimensions (inches)

| Step | Width | Height | Length |
|---|---|---|---|
| 1, 15 (shortest steps at ends of ridge) | 0.016 | 0.010 | 0.016 |
| 2, 14 | 0.024 | 0.014 | 0.022 |
| 3, 13 | 0.034 | 0.020 | 0.032 |
| 4, 12 | 0.048 | 0.029 | 0.046 |
| 5, 11 | 0.069 | 0.041 | 0.065 |
| 6, 10 | 0.098 | 0.059 | 0.093 |
| 7, 9 | 0.140 | 0.084 | 0.133 |
| 8 (central-most step of ridge) | 0.200 | 0.120 | 0.380 |

TABLE 2

Post Dimensions (inches)

| Post | Length |
|---|---|
| a, o (shortest posts at ends of ridge) | 0.007 |
| b, n | 0.010 |
| c, m | 0.014 |
| d, l | 0.020 |
| e, k | 0.029 |
| f, j | 0.042 |
| g, h | 0.060 |
| i, i (two central posts on central step of ridge) | 0.085 |

In this example, the projections each have a width of 0.040 inches, and the total length of ridge 1101 is 1.194 inches. In one embodiment, a waveguide polarizer having a pair of ridges 1101 configured as listed in Tables 1 and 2 disposed opposite one another on the inner surface of a waveguide body having a length of 2 inches and an inner diameter of 0.710, was calculated to have a bandwidth of approximately 51%. It should be appreciated that the performance of such a waveguide polarizer is not highly sensitive to the width of the projections or to the length of the waveguide body, so long as the waveguide body is about as long as, or slightly longer than, the ridges 1101.

In some embodiments, the ridges may be omitted entirely, and the waveguide body instead shaped to dimensionally perturb the ridge in a similar fashion to a ridge. For example, if the waveguide body is rectangular with a height and a width, wherein the height is smaller than the width, the smaller dimension along the height may provide a similar function to a pair of ridges. Analogously, if the waveguide body is elliptical with a major axis and a minor axis, wherein the dimension along the minor axis is smaller than the dimension along the major axis, the smaller dimension along the minor axis may perform a similar function to a pair of ridges. The waveguide body can alternatively be deformed to provide one or more ridge-like structures.

Additionally, the lengths of the projections may be "detuned" to provide dual-band performance. Specifically, in many of the embodiments described above, the length of the projections may be selected to give as wide a bandwidth of performance as is desired, for example so that the "combination" curve illustrated in FIG. 4B is made as flat as possible over a desired bandwidth range. Increasing the lengths of the projections from such a length may cause the lower portion of "combination" curve to drop further below 90 degrees. At such a length, the "combination" curve may provide a 90 degree phase shift both at a relatively high frequency, and at a relatively low frequency. As such, the waveguide polarizer may be used to induce a 90-degree phase shift in two different bands—one centered at the relatively high frequency, and the other centered at the relatively low frequency. Such a configuration may thus increase the amount of information that the waveguide polarizer is capable of processing.

While preferred embodiments of the invention are described herein, it will be apparent to one skilled in the art that various changes and modifications may be made. The appended claims are intended to cover all such changes and modifications that fall within the true spirit and scope of the invention.

What is claimed:

1. A waveguide polarizer, comprising:

a hollow waveguide body having an interior surface;

a first ridge disposed on the interior surface of the hollow waveguide body and having an inward-facing surface;

a first plurality of projections disposed on the inward-facing surface of the first ridge, the projections of the first plurality having a width and a length, wherein the width is narrower than a width of the first ridge, and wherein the length is tunable;

a second ridge disposed on the interior surface of the hollow waveguide body opposite the first ridge, the second ridge having an inward-facing surface;

a second plurality of projections disposed on the inward-facing surface of the second ridge, the projections of the second plurality having a width and a length, wherein the width is narrower than a width of the second ridge, and wherein the length is tunable;

third and fourth ridges disposed on the interior surface of the hollow waveguide body, the third ridge and the fourth ridge each having an inward-facing surface;

a third plurality of projections disposed on the inward-facing surface of the third ridge; and a fourth plurality of projections disposed on the inward-facing surface of the fourth ridge, the third and fourth ridges each having a height that is shorter than a height of the first and second ridges, the third and fourth ridges being disposed orthogonally to the first and second ridges, and the projections of the third and fourth pluralities having a length that is shorter than the length of the projections of the first and second pluralities.

2. The waveguide polarizer of claim 1, wherein the length of the projections is tuned so as to induce about a 90-degree phase delay in a first mode propagating in a plane parallel to the first ridge relative to a second mode propagating in a plane perpendicular to the first ridge.

3. The waveguide polarizer of claim 1, wherein the projections comprise screws.

4. The waveguide polarizer of claim 1, wherein the projections comprise cylindrical posts.

5. The waveguide polarizer of claim 1, wherein the projections comprise rectangular posts.

6. The waveguide polarizer of claim 1, wherein the waveguide polarizer has a bandwidth of at least 30% about a center wavelength.

7. The waveguide polarizer of claim 1, wherein the waveguide polarizer has a bandwidth of at least 50% about a center wavelength.

8. The waveguide polarizer of claim 1, wherein the first plurality of projections comprises between four and fifty projections.

9. The waveguide polarizer of claim 1, wherein each of the projections comprises a conductor.

10. The waveguide polarizer of claim 9, wherein the conductor comprises a metal selected from the group consisting of aluminum, magnesium, zinc, titanium, steel, chromium, or gold.

11. The waveguide polarizer of claim 1, wherein the hollow waveguide body has a substantially symmetrical cross section.

12. The waveguide polarizer of claim 1, wherein the first ridge is formed integrally with the waveguide body.

13. The waveguide polarizer of claim 1, wherein the first ridge has a height and a length, the height being substantially uniform along the length.

14. The waveguide polarizer of claim 1, wherein the first ridge has a height and a length, the height varying along the length.

15. The waveguide polarizer of claim 14, wherein the width of the first ridge varies along the length.

16. The waveguide polarizer of claim 1, wherein the first ridge has a length, the length being approximately equal to a wavelength of a mode propagating through the waveguide body.

17. A method of forming a waveguide polarizer, the method comprising:

providing a waveguide body having an interior surface;

providing a ridge;

providing a plurality of projections having a width that is narrower than a width of the ridge;

coupling the ridge to the interior surface of the waveguide body, the ridge having an inward-facing surface;

coupling the plurality of projections to the inward-facing surface of the ridge, wherein coupling the plurality of projections to the inward-facing surface of the ridge comprises screwing each of the projections into the ridge; and tuning a length of each of the projections, wherein tuning the length of each of the projections comprises selecting a depth to which each of the projections are screwed into the ridge based on a phase delay to be induced in a mode propagating parallel to the ridge relative to a mode propagating perpendicular to the ridge.

* * * * *